US011920884B1

(12) United States Patent
Lee

(10) Patent No.: US 11,920,884 B1
(45) Date of Patent: Mar. 5, 2024

(54) HEAT SHIELD FOR FIREARM SUPPRESSOR

(71) Applicant: Devhold Inc., Fort Myers, FL (US)

(72) Inventor: Darryl S. Lee, Fort Myers, FL (US)

(73) Assignee: Devhold Inc., Ft. Myers, FL (US)

( * ) Notice: Subject to any disclaimer, the term of this patent is extended or adjusted under 35 U.S.C. 154(b) by 302 days.

(21) Appl. No.: 17/358,274

(22) Filed: Jun. 25, 2021

Related U.S. Application Data

(63) Continuation-in-part of application No. 16/714,231, filed on Dec. 13, 2019, now Pat. No. 11,047,640, which is a continuation-in-part of application No. 16/031,483, filed on Jul. 10, 2018, now Pat. No. 10,508,879, which is a continuation of application No. 15/819,893, filed on Nov. 21, 2017, now Pat. No. 10,048,033.

(51) Int. Cl.
*F41A 21/34* (2006.01)
*F41A 21/30* (2006.01)
*F41A 21/44* (2006.01)

(52) U.S. Cl.
CPC ..... *F41A 21/34* (2013.01); *F41A 21/30* (2013.01); *F41A 21/44* (2013.01)

(58) Field of Classification Search
CPC ..... F41A 21/30–38; F41A 21/44; F41A 13/12
USPC ..... 89/14.1–14.4; 181/223; 165/177–184
See application file for complete search history.

(56) References Cited

U.S. PATENT DOCUMENTS 2,351,037 A 6/1944 Green
2,866,288 A 12/1958 Herter
3,045,379 A 7/1962 Cutts
3,710,679 A 1/1973 Werbell, III
3,797,155 A 3/1974 Smith et al.
4,346,643 A * 8/1982 Taylor ..... F41A 21/44 165/104.26
4,753,154 A * 6/1988 Higashi ..... F41A 13/12 165/104.26
4,762,048 A * 8/1988 Higashi ..... F41A 21/44 165/47
6,973,863 B1 12/2005 Jones
7,194,836 B1 3/2007 Urban
(Continued)

FOREIGN PATENT DOCUMENTS

EP 2615403 A2 7/2013
WO 2009139803 A2 11/2009

*Primary Examiner* — Joshua E Freeman
*Assistant Examiner* — Benjamin S Gomberg
(74) *Attorney, Agent, or Firm* — Nicholas Pfeifer; Smith & Hopen, P. A.

(57) ABSTRACT

A universal firearm shield adapted to attach to a firearm suppressor. Suppressors fail to dampen all of the effects of firearm discharge, leaving behind residual effects that may be noticeable. The shield dampens the residual effects of firearm discharge that are not captured by the suppressor. The residual effects are captured by the shield and dispersed throughout one or more interior chambers. The shield easily, quickly, and securely couples to suppressors of varying geometries due to the slidably adjustable components of the shield. The shield is configured to surround the suppressor and axially align with the suppressor. As such, the muzzle of the firearm axially aligns with the shield, the suppressor, and the barrel for an unobstructed projectile path during discharge.

20 Claims, 19 Drawing Sheets

(56) References Cited

U.S. PATENT DOCUMENTS

| | | | | |
|---|---|---|---|---|
| 8,397,615 | B2 * | 3/2013 | Poling | F41A 21/30 89/14.3 |
| 8,973,481 | B2 | 3/2015 | Dueck et al. | |
| 9,140,511 | B2 * | 9/2015 | Michal | F41A 21/44 |
| 9,435,600 | B2 * | 9/2016 | Oliver | F41A 21/24 |
| 10,001,340 | B1 * | 6/2018 | Oglesby | F41C 23/18 |
| 10,386,146 | B2 * | 8/2019 | Spector | F41G 11/003 |
| 10,466,003 | B2 * | 11/2019 | Thompson | F41A 21/24 |
| 11,150,045 | B1 * | 10/2021 | Oglesby | F41A 21/30 |
| 2015/0184968 | A1 | 7/2015 | Fischer et al. | |
| 2015/0362276 | A1 | 12/2015 | Fischer | |
| 2017/0153080 | A1 * | 6/2017 | Roberts | F41A 21/44 |
| 2018/0292164 | A1 | 10/2018 | Thompson et al. | |
| 2018/0306546 | A1 * | 10/2018 | Roberts | F41A 13/12 |
| 2021/0404761 | A1 * | 12/2021 | Le Sage | F41A 21/44 |

* cited by examiner

Fig. 29
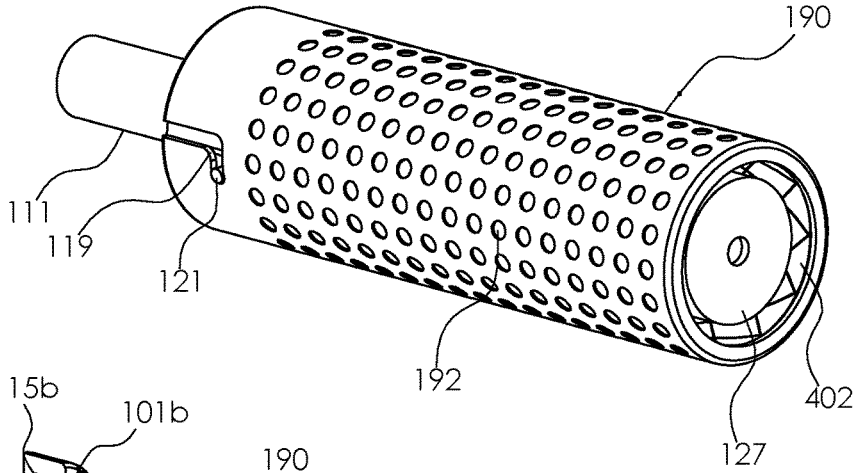
Fig. 30
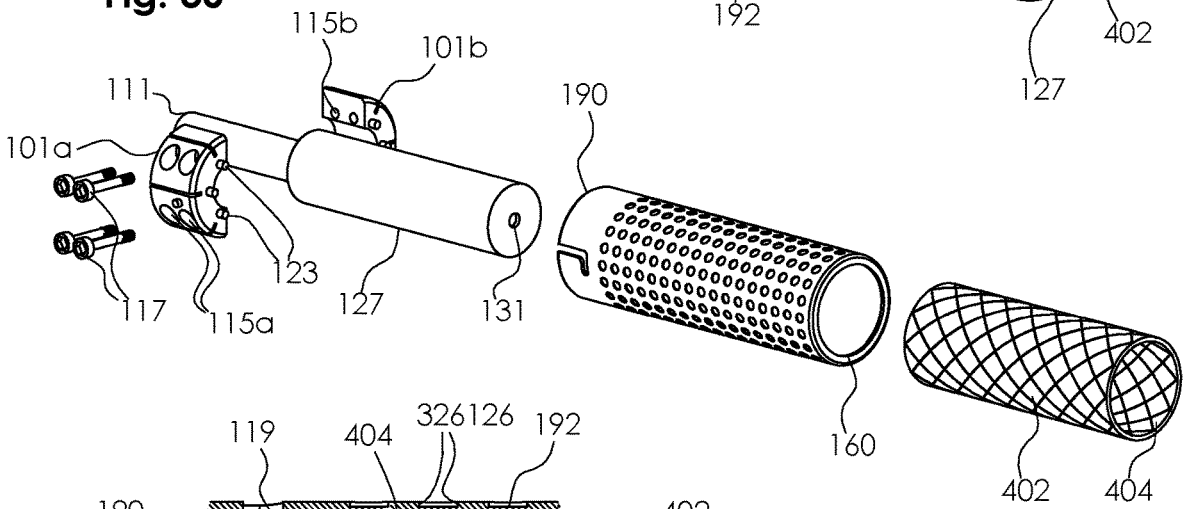
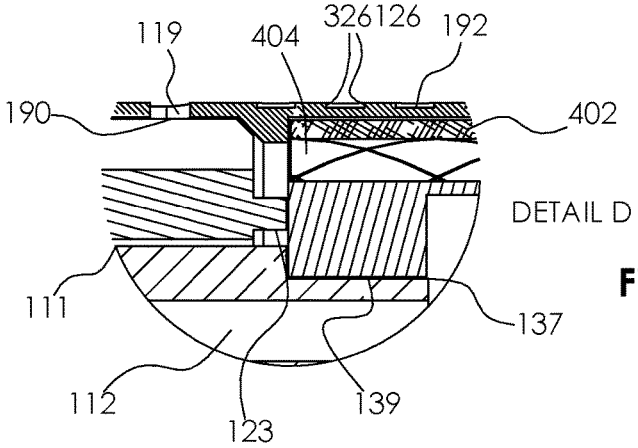
Fig. 32
Fig. 31
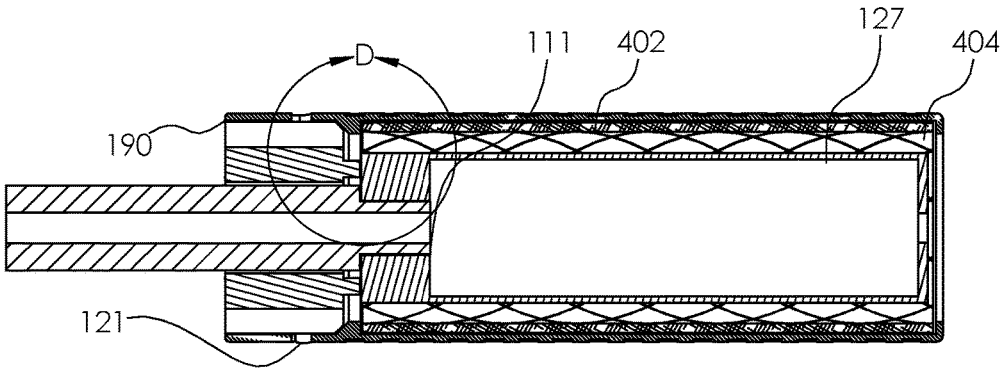

Fig. 33
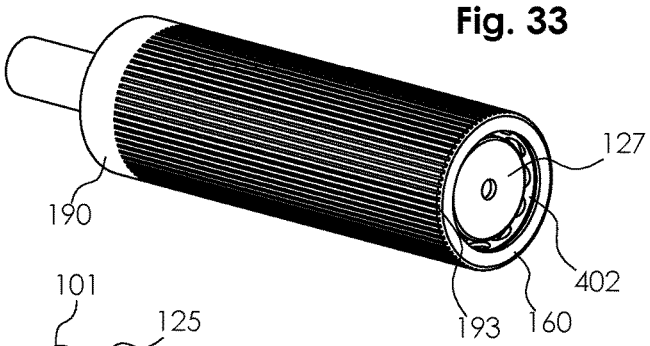
Fig. 34
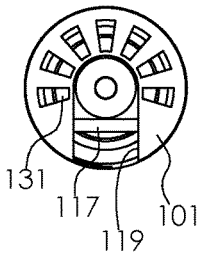
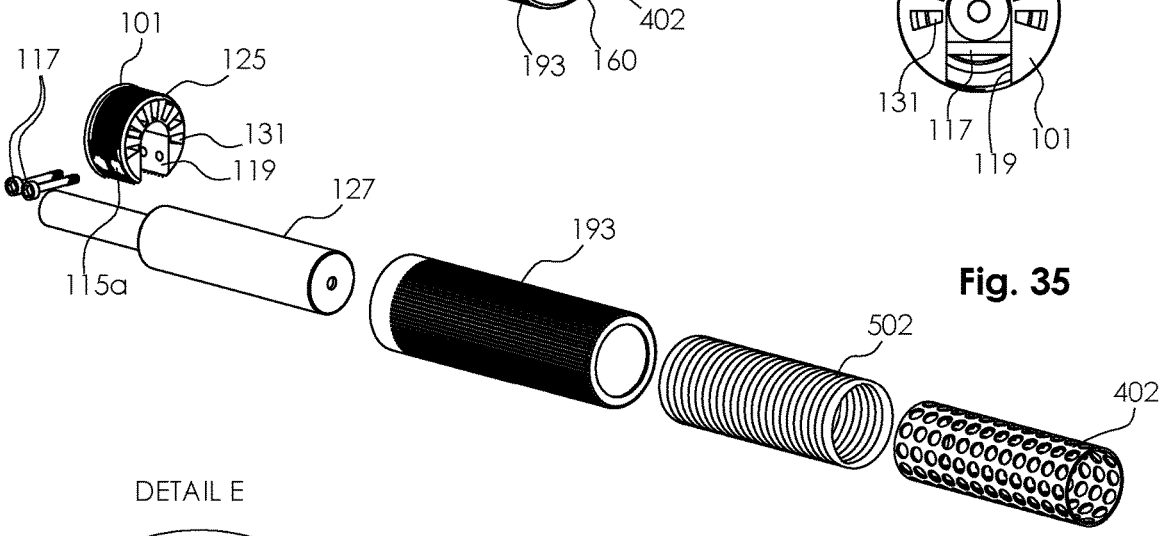
Fig. 35
DETAIL E
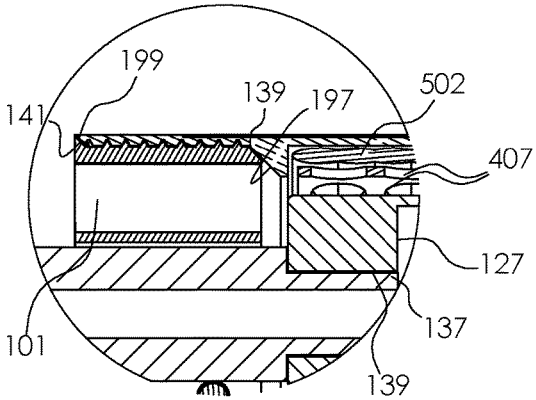
Fig. 37
Fig. 36
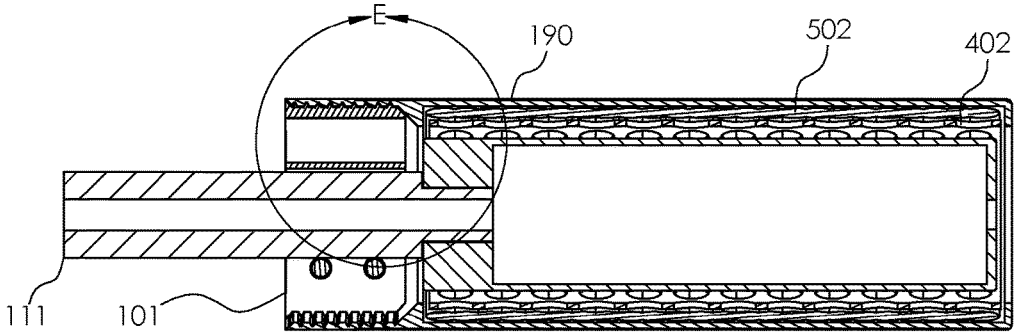

HEAT SHIELD FOR FIREARM SUPPRESSOR

CROSS-REFERENCE TO RELATED APPLICATIONS

This nonprovisional application is a continuation-in-part of and claims priority to nonprovisional application Ser. No. 16/714,231 entitled "DEVICE FOR DAMPENING RESIDUAL EFFECTS FROM A FIREARM SUPPRESSOR," filed Dec. 13, 2019 by the same inventor, which is a continuation-in-part of and claims priority to nonprovisional application Ser. No. 16/031,483, now U.S. Pat. No. 10,508,879 issued on Dec. 17, 2019, entitled "DEVICE FOR DAMPENING RESIDUAL EFFECTS FROM A FIREARM SUPPRESSOR," filed Jul. 10, 2018 by the same inventor, which is a continuation of and claims priority to nonprovisional application Ser. No. 15/819,893, now U.S. Pat. No. 10,048,033 issued on Aug. 14, 2018, entitled "DEVICE FOR DAMPENING RESIDUAL EFFECTS FROM A FIREARM SUPPRESSOR," filed Nov. 21, 2017 by the same inventor.

BACKGROUND OF THE INVENTION

1. Field of the Invention

This invention relates, generally, to firearm suppressors. More specifically, it relates to an adjustable sound, light, and heat shield configured to mount to a suppressor on a firearm and axially align with the firearm barrel.

2. Brief Description of the Prior Art

Increased use of firearms has led to a desire to dampen the audible and visual effects associated with firearms. The suppression of sound, light, and heat from firearms is especially important in law enforcement and military operations. For example, it may be desirable for military personnel to remain hidden during an operation to prevent alerting an enemy combatant of their locations. Such military personnel often use firearm suppressors to remain hidden while discharging their weapons. Similarly, people often use suppressors when shooting targets on their property to prevent firearm noise from becoming a nuisance to neighbors. Hunters also use suppressors to prevent alerting animals of their presence.

Typically, firearm suppressors quiet the report of discharge to a safe level of less than 140 decibels. The resulting decibel level of suppressed gunfire is safer than unsuppressed gunfire, but can still be uncomfortably loud or even dangerous to a listener. This problem is especially present in interior combat situations, because the soundwaves created by gunfire ricochet against the walls, floor, and ceiling of an interior area, potentially causing hearing problems.

While gunfire reduced to 140 decibels is usually considered a safe degree of loudness, the suppressors may still fail to mask the presence of law enforcement or military personnel to a hostile party. The hostile party may become aware of an officer despite the use of a suppressor, placing the officers in great danger. Similarly, the noise generated despite the use of a suppressor can be bothersome to a hunter, as it can alert animals of the presence of the hunter.

The audible effects generated by a firearm during discharge include vibrational and acoustical soundwaves. When a firearm is discharged, vibrational and acoustical soundwaves travel through the barrel and escape from the firearm, leading to an audible noise. However, remnant effects of suppressed gunfire exist even with the use of a firearm suppressor. Suppressors fail to contain all of the vibrational soundwaves resulting from a firearm discharge. Instead, remnant vibrational soundwaves result from the contact between exploding blast gasses and the body of the suppressor. The vibrational soundwaves transfer through the body of the suppressor and radiate into the environment exterior to the suppressor. As such, the suppressor radiates vibrational soundwaves, which can alert a party of the presence of a firearm. Similarly, residual acoustical soundwaves escape the bore of the suppressor after a bullet is discharged through the suppressor bore. As the explosion of blast gas grows within the interior of the suppressor, the expanding gases are forced from the larger interior chamber of the suppressor, through the narrow aperture of the distal bore of the suppressor. When this occurs, the gases increase in velocity, and the corresponding acoustical soundwaves are amplified as they escape into the exterior environment.

Firearms also generate visual effects during discharge, including light and heat energy. The light and heat discharged by a firearm are partially dampened by a suppressor. The light energy results from the burning of propellant gas as a bullet leaves the barrel of the firearm. The hot gas reacts with the surrounding air at the muzzle of the gun, creating a flash of light referred to as the "muzzle blast" of the discharge. While suppressors capture some of the light from the reaction, some of the light energy escapes through the bore of the suppressor. The residual light is especially dangerous during low-light conditions, since the light contrasts with the darkness of the environment. Such light discharge can be deadly to law enforcement or military personnel if noticed by a hostile party.

Similarly, the burning of propellant gas generates heat energy that can exceed temperatures of 3,000° Fahrenheit. Suppressors are designed to absorb the heat generated from the high-temperature explosion resulting from gunfire, retaining the heat until the suppressor cools. However, residual heat can escape from the firearm during discharge, which can alert a party of the presence of a weapon. Equally dangerous is the heat signature of the suppressor upon absorption of heat after discharge. Since the suppressor is adapted to absorb and retain heat, the radiated heat can be detected by a hostile party, either through the naked eye or specialized electronic equipment. Again, the detection of the heat signature can be deadly to law enforcement or military personnel.

In addition, burns from hot suppressors are a common occurrence among suppressor users. Burns of the hands and legs of shooters from unintentional touching of a hot suppressor are frequent. Many times this can be caused by the lack of understanding of the temperature differential between the firearm barrel and the suppressor.

In most firing situations, the suppressor is substantially hotter than the barrel of the firearm to which the suppressor is attached. During the firing sequence, suppressors carry more heat than the barrel due to multiple factors, including firearm barrels being thicker than suppressor bodies, and barrels having no internal chambers to capture and contain blast gases. Suppressors, on the other hand, are designed to capture and hold the expanding blast gases within the internal chamber of the suppressor body. This causes the body of a suppressor to become heated to a dangerous level before the firearm barrel reaches a similar temperature. During a rapid fire sequence, a centerfire rifle suppressor can quickly reach temperatures over 1000 degrees Fahrenheit. Any contact with skin or clothing at these temperatures, will result in burns of varying degrees.

All prior art related to suppressor shields or covers feature some form of conduction heat transfer. This causes direct contact conduction heat transfer into the outer body of the shield. Even if through layers, the direct contact surface heat of the suppressor, is transferred to the outer sleeve of the shield. Almost all suppressor covers use a heat resistant sleeve that slides onto the outer body of the suppressor. The problem is the direct contact with the body of the suppressor causes heat to transfer to the outer surface of the heat shield via thermal conduction.

Accordingly, what is needed is a shield that can decrease the sound, light, and heat associated with the discharge of a firearm, despite the use of a suppressor. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an adjustable sound, light, and heat shield configured to mount to a suppressor on a firearm and axially align with the firearm barrel is now met by a new, useful, and nonobvious invention.

The novel structure includes a residual effect shield used in combination with a firearm suppressor. The shield includes a proximal enclosure and a distal enclosure. The proximal enclosure has a proximal end, a distal end, and a body disposed therebetween. The proximal end includes an aperture sized to receive a portion of a firearm barrel.

The distal enclosure includes a distal end, a proximal end, and a body extending therebetween. The distal end includes a projectile aperture. A tapered structure is disposed within the body and longitudinally-spaced from the distal end to create a distal chamber. The tapered structure includes a proximal inner diameter that is greater than a distal inner diameter. As such, the tapered structure may be frustoconical in shape. The tapered structure is adapted to mate with the firearm suppressor, thereby aligning the firearm suppressor with the firearm barrel and the projectile aperture. In an embodiment, the tapered structure includes comprises a fluidic channel extending therethrough. The fluidic channel enables fluid in the distal chamber to pass through the tapered structure.

In an embodiment, the proximal and distal enclosures are configured to attach to each other in an axially aligned configuration. Each of the proximal and distal enclosures include an inner diameter that is greater than an outer diameter of the firearm suppressor. At least some of the residual effects of a firearm discharge are dispersed throughout the proximal and distal enclosures.

In an embodiment, the proximal and distal enclosure include complementary threading. As such, the proximal and distal enclosures are adapted to threadedly mate via the complementary threading.

In one embodiment, the proximal and distal enclosures are housed within a housing. An interior surface of the housing and an exterior surface of both the proximal and distal enclosures include complementary threading. Accordingly, the housing threadedly engages with the proximal and distal enclosures via the complementary threading.

An interception device may be disposed adjacent to the projectile aperture. The interception device is tapered such that a distal diameter is greater than a proximal diameter. The interception device is adapted to direct the residual effects of the firearm discharge away from the projectile aperture and into the distal chamber.

An embodiment of a residual effect shield used in combination with a firearm suppressor includes an enclosure housing a compression sleeve, a spring, and an alignment partition. The enclosure includes a proximal end, a distal end, and a body disposed therebetween. The distal end includes a projectile aperture. The body may include a threaded portion.

The enclosure may include an interior receipt having an outer diameter that is smaller than an inner diameter of the enclosure. The different in diameters creates a translation channel between the enclosure and the interior receipt. The translation channel is in fluid communication with the chamber, thereby enabling fluid in the chamber to disperse into the translation channel.

The compression sleeve includes a proximal end, a distal end, and a body extending therebetween. The proximal end includes an aperture sized to receive a portion of a firearm barrel. The proximal end also includes at least one attachment arm adapted to translate in a radial direction to grip a proximal end of the firearm suppressor. Accordingly, the compression sleeve is adapted to exert a force against the firearm suppressor in an axial direction toward the distal end of the enclosure. The distal end of the compression sleeve is in communication with the body of the enclosure. In an embodiment, the distal end of the compression sleeve includes a threaded portion complementary to the threaded portion of the enclosure. As such, the compression sleeve is adapted to threadedly engage with the enclosure.

The spring is disposed at the distal end of the enclosure, the spring adapted to exert a force against the alignment partition in an axial direction toward the proximal end of the enclosure.

The alignment partition is disposed within the body of the enclosure and longitudinally-spaced from the distal end of the enclosure via the spring thereby creating a chamber. Accordingly, the alignment partition is adapted to contact a distal end of the firearm suppressor. At least some of the residual effects of a firearm discharge are dispersed throughout the chamber. The compression sleeve and the alignment partition are configured to align the firearm suppressor with the firearm barrel and the projectile aperture. The alignment partition may be adapted to axially translate along the translation channel formed by the interior receipt of the enclosure.

In an embodiment, the alignment partition includes a tapered structure. The tapered structure has a proximal inner diameter that is greater than a distal inner diameter. The tapered structure is configured to engage with the distal end of the firearm suppressor. The distal inner diameter is less than or equal to an outer diameter of the firearm suppressor. The tapered structure may be frustoconical in shape, such that the tapered structure is adapted to align the firearm suppressor with the firearm barrel and the projectile aperture.

In one embodiment, the alignment partition includes a fluidic channel extending therethrough, thereby enabling fluid in the chamber to pass through the alignment partition.

An embodiment of the present invention is a novel method for dampening residual effects of a firearm discharge from a firearm suppressor. The method includes enclosing a firearm suppressor within a shield, with the firearm suppressor attaching to a portion of a firearm barrel. The shield includes a proximal portion opposite a distal portion. The distal portion includes a tapered structure longitudinally-spaced from a projectile aperture. The tapered structure has a proximal inner diameter that is greater than a distal inner diameter.

The method includes a step of aligning the shield with the firearm suppressor by axially forcing the firearm barrel into the shield. As such, the firearm suppressor engages with the tapered structure, thereby causing the firearm suppressor to funnel into alignment with the shield. Upon discharge, at least some of the residual effects of a firearm discharge are dispersed throughout the shield.

An embodiment of the present invention includes a method of reducing the possibility of burning oneself on a firearm suppressor using a suppressor shield having a proximal enclosure and a housing. The method includes attaching the proximal enclosure to a firearm barrel, such that the proximal enclosure is secured to a firearm barrel at a location that is proximal to a location of the firearm suppressor when the firearm suppressor and suppressor shield are secured to the firearm and enclosing within the housing a majority of the firearm suppressor when the firearm suppressor is attached to a portion of a firearm barrel. The housing is integrated with or attachable to the proximal enclosure. In addition, the housing further includes a bore extending in a longitudinal direction, the bore establishing an interior receiving space for receiving at least a portion of the firearm suppressor; an outer surface with a fixed shape; and a distal projectile aperture. In an embodiment, the firearm suppressor includes a plurality of baffles.

In an embodiment, the step of axially aligning the housing with the firearm further includes axially forcing the suppressor into a frustoconical structure housed within the interior receiving space such that the frustoconical structure funnels the firearm suppressor into alignment with the housing.

In an embodiment, the step of attaching the proximal enclosure to a firearm barrel includes threadedly mating the proximal enclosure, via threading on an internal surface of the proximal enclosure, to threads disposed on a threaded extension on the firearm barrel.

In an embodiment, the housing further includes a first insulating sleeve disposed within the housing. The first insulating sleeves has an internal diameter greater than the firearm suppressor to prevent the first insulating sleeve from contacting the outer lateral surface of the firearm suppressor. In an embodiment, the first insulating sleeve is comprised of a mesh fabric or a porous rigid or semi-rigid material.

In an embodiment, the proximal enclosure includes a plurality of airflow chambers longitudinally disposed therein. In an embodiment, the housing includes a plurality of recessed features disposed in the outer rigid or semi-rigid surface.

An embodiment further includes threadedly securing the housing to the proximal enclosure via threads disposed on an outer surface of the proximal enclosure. An embodiment includes clamping the proximal enclosure around the firearm barrel by tightening fasteners that span across a longitudinal slot in the proximal enclosure.

In an embodiment of the suppressor shield for protecting oneself from a hot firearm suppressor, the suppressor shield includes a proximal enclosure configured to be connected to a firearm barrel. The proximal enclosure has an internal surface that is sized or adjustable in size to contact at least a portion of the firearm barrel when the proximal enclosure is secured to the firearm barrel. A housing is integrated with or attachable to the proximal enclosure. The housing further includes a bore extending in a longitudinal direction, an outer rigid or semi-rigid surface, and a distal projectile aperture. The bore establishes an interior receiving space for receiving at least a portion of the firearm suppressor. An air gap resides between an outer lateral surface of the firearm suppressor and an interior surface of the housing.

An embodiment also includes complementary threading on the proximal enclosure and the housing, wherein the proximal enclosure and the housing threadedly mate via the complementary threading. In an embodiment, the proximal enclosure includes threads on the internal surface. The threads are configured to threadedly engage threads disposed on a threaded barrel extension at a muzzle end of the firearm barrel. In an embodiment, the proximal enclosure includes a longitudinal slot, such that the internal surface can be reduced in size to clamp around the firearm barrel. The proximal enclosure may also include a plurality of airflow chambers longitudinally disposed therein.

An embodiment includes a frustoconical structure disposed within the housing, such that the frustoconical structure funnels the firearm suppressor into axial alignment with the housing. An embodiment also includes a first insulating sleeve disposed within the housing. The first insulating sleeves has an internal diameter greater than the firearm suppressor to prevent the first insulating sleeve from contacting the outer lateral surface of the firearm suppressor.

In an embodiment, the housing includes a plurality of recessed features disposed in the outer rigid or semi-rigid surface. In an embodiment, the housing includes an open underside to allow heat to escape from the open underside.

An embodiment of the present invention includes method of reducing the possibility of burning oneself on a firearm suppressor using a suppressor shield. The method includes receiving a firearm and the firearm suppressor, wherein the firearm suppressor is attached to or attachable to a barrel of the firearm and the firearm suppressor includes a nonperforated outer lateral surface adapted to contain gasses from firing the firearm; and ensleeving a housing at least partially around the firearm suppressor via an interference fit.

The housing includes a bore extending in a longitudinal direction. The bore establishes a rigid lateral wall and an interior receiving space for receiving at least a portion of the firearm suppressor. The housing further includes an outer surface; an internal surface establishing the boundaries of the bore; a proximal aperture having a diameter greater than a diameter of the suppressor, thereby allowing the suppressor to be received within the bore; a distal projectile aperture; and an insulating sleeve secured or attachable to the housing with at least a portion of the insulating sleeve residing between the internal surface of the housing and the outer lateral surface of the suppressor when the housing is attached to the suppressor. The insulating sleeve thereby prevents the internal surface of the housing from directly contacting the outer lateral surface of the firearm suppressor when the housing is attached to the firearm suppressor.

Some embodiments of the housing further include a longitudinal slot extending a length of the housing, such that a diameter of the internal surface of the housing can change from an unflexed diameter to a larger diameter when subject to a force. In addition, an unflexed radius of the internal surface of the housing has a value less than the sum of (1) an outer radius of the of the suppressor and (2) a thickness of the insulating sleeve when not subject to a compressive force. In some embodiments, the rigid lateral wall of the housing is more rigid than the insulating sleeve.

In some embodiments, the insulating sleeve is comprised of a compressible textile to aid in the creating the interference fit. In some embodiments, the insulating sleeve is comprised of a plurality of longitudinally extending strips of insulating material. In some embodiments, the insulating sleeve is comprised of a plurality of strips of insulating material extending around the circumference of the internal surface of the housing. In some embodiments, wherein the insulating sleeve is comprised of a plurality of discrete insulating ropes. The embodiments using ropes may further include a plurality of notches or openings passing through the lateral wall of the housing and one or more of the plurality of insulating ropes passing through each of the plurality of notches or openings.

Some embodiments of the housing include one or more stops. Each stop is configured to translate within the longitudinal slot and be secured to the housing at a particular location along the longitudinal slot. Moreover, each stop extends a distance inwardly towards a longitudinal axis of the suppressor. The distance is greater than the spacing between the internal surface of the housing and the outer surface of the suppressor when the housing is ensleeving the suppressor.

Some embodiments of the housing include a plurality of vents laterally disposed through the lateral wall of the housing. Some embodiments of the housing include a plurality of recessed features disposed in the outer surface.

In some embodiments, the present invention includes a suppressor shield for protecting oneself from a hot firearm suppressor. The suppressor shield includes a housing configured to at least partially ensleeve the firearm suppressor via an interference fit. The housing includes a bore extending in a longitudinal direction, which establishes a rigid lateral wall and an interior receiving space for receiving at least a portion of the firearm suppressor. The housing further includes an outer surface; an internal surface establishing the boundaries of the bore; a proximal aperture having a diameter greater than a diameter of the suppressor, thereby allowing the suppressor to be received within the bore; a distal projectile aperture; and a longitudinal slot extending a length of the housing, such that a diameter of the internal surface of the housing can change from an unflexed diameter to a larger diameter when subject to a force.

The shield further includes an insulating sleeve configured to reside between the internal surface of the housing and an outer lateral surface of the firearm suppressor when the housing is attached to the firearm suppressor. The insulating sleeve prevents the internal surface of the housing from directly contacting the outer lateral surface of the suppressor when the housing ensleeves at least a portion of the suppressor to reduce the transfer of heat from the firearm suppressor to the housing.

In some embodiments the rigid outer surface of the housing is comprised of a more rigid material than the insulating sleeve and the internal surface of the housing having an unflexed radius that is less than the sum of (1) an outer radius of the of the suppressor and (2) a thickness of the insulating sleeve when the insulating sleeve is not subject to a compressive force.

In some embodiments, the insulating sleeve is comprised of a compressible textile to aid in the creating the interference fit. In some embodiments, the insulating sleeve is comprised of a plurality of longitudinally extending strips of insulating material. In some embodiments, the insulating sleeve is comprised of a plurality of strips of insulating material extending around the circumference of the internal surface of the housing. In some embodiments, wherein the insulating sleeve is comprised of a plurality of discrete insulating ropes. The embodiments using ropes may further include a plurality of notches or openings passing through the lateral wall of the housing and one or more of the plurality of insulating ropes passing through each of the plurality of notches or openings.

Some embodiments of the housing include one or more stops. Each stop is configured to translate within the longitudinal slot and be secured to the housing at a particular location along the longitudinal slot. Moreover, each stop extends a distance inwardly towards a longitudinal axis of the suppressor. The distance is greater than the spacing between the internal surface of the housing and the outer surface of the suppressor when the housing is ensleeving the suppressor.

Some embodiments of the housing include a plurality of vents laterally disposed through the lateral wall of the housing. Some embodiments of the housing include a plurality of recessed features disposed in the outer surface.

It is an object of the invention to provide a device that further dampens the sound, light, and heat emitted from a firearm including a firearm suppressor. The shield of the present invention can be retrofit to a multitude of firearms and firearm suppressors having various geometries via adjustable dampening components. The shield includes one or more chambers to receive the residual effects of a firearm discharge from the firearm suppressor, thereby dampening the residual effects noticeable exterior to the firearm.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which:

FIG. 29 is a perspective view of an embodiment of a residual effect shield mounted on a firearm suppressor and a firearm barrel.

FIG. 30 is an exploded view of the embodiment depicted in FIG. 29.

FIG. 31 is a sectional view of the embodiment depicted in FIG. 29.

FIG. 32 is a close-up view of section D depicted in FIG. 31.

FIG. 33 is a perspective view of an embodiment of a residual effect shield mounted on a firearm suppressor and a firearm barrel.

FIG. 34 is a cross-sectional view from a proximal end of the embodiment depicted in FIG. 33.

FIG. 35 is an exploded view of the embodiment depicted in FIG. 33.

FIG. 36 is a sectional view of the embodiment depicted in FIG. 33.

FIG. 37 is a close-up view of section E depicted in FIG. 36.

DETAILED DESCRIPTION OF THE INVENTION

Figure 1:
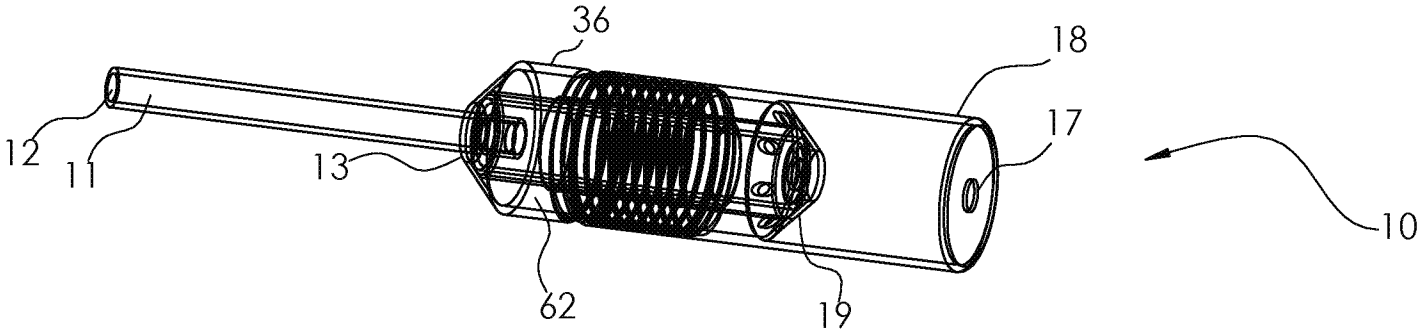
FIG. 1 is a perspective view of a residual effect shield mounted on a firearm suppressor and a firearm barrel.

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention includes a universal residual effect shield configured to mount to a firearm suppressor or firearm barrel. While the firearm suppressor decreases the sound, light, and heat emitted by the firearm during discharge, residual effects may still be detectable outside of the firearm. The shield of the present invention includes at least one enclosure adapted to receive residual effects of a firearm discharge, thereby dampening the residual effects of the firearm.

Referring to FIGS. 1-6, an embodiment of the shield, generally denoted by reference numeral 10, is depicted. Shield 10 is adapted to enclose (also described herein as "ensleeve") suppressor 27, thereby surrounding suppressor 27. In order to ensleeve suppressor 27, shield 10 includes proximal enclosure 36 and distal enclosure 18. Each of proximal and distal enclosures 36, 18 is configured to attach to and surround suppressor 27. Moreover, proximal enclosure 36 threadedly engages with distal enclosure 18, forming shield 10 that ensleeves suppressor 27. Shield 10 captures the residual effects of firearm discharge that are not absorbed by suppressor 27.

Figure 2:
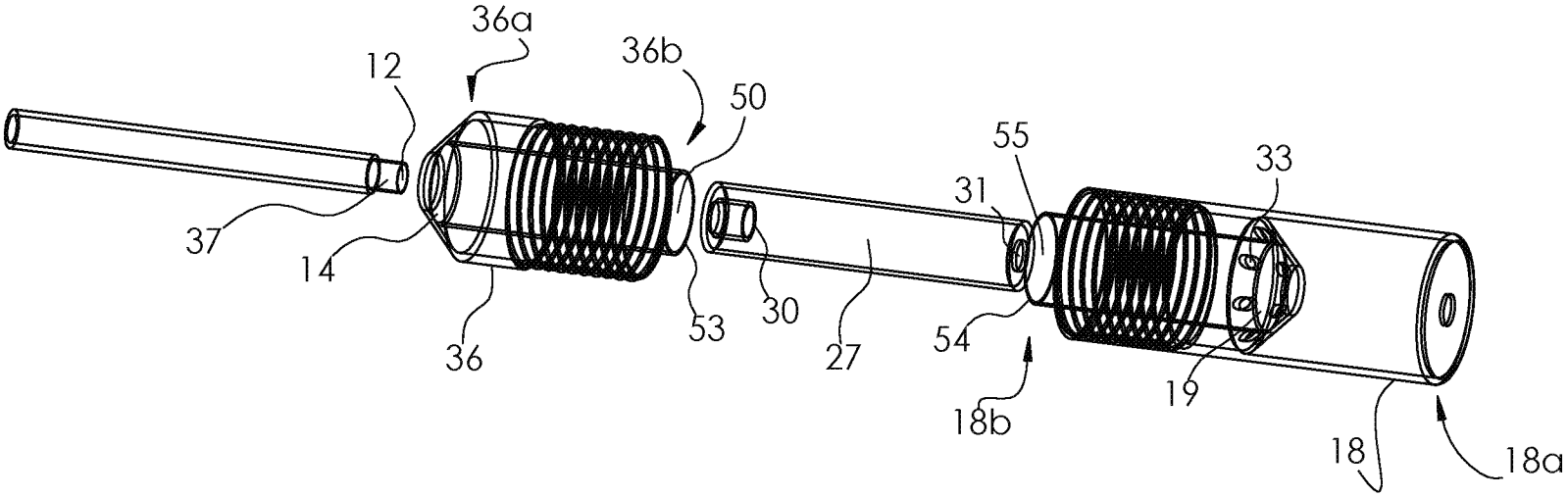
FIG. 2 is an exploded view of the components of FIG. 1.
Figure 5:
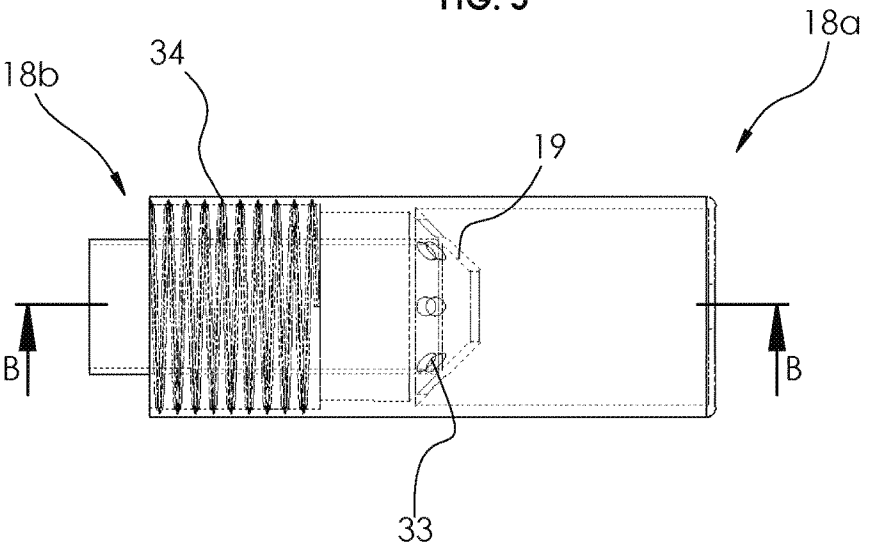
FIG. 5 is a side view of a distal enclosure of the residual effect shield.

As shown in FIGS. 1-2, proximal enclosure 36 includes a proximal end 36*a*, chamber 62, and a distal end 36*b*, with a body disposed between proximal end 36*a* and distal end 36*b*. Proximal end 36*a* is adapted to receipt at least a portion of a firearm barrel 11. Similarly, distal end 36*b* is adapted to mate with suppressor 27. Chamber 62 is disposed within the body of proximal enclosure 36 between proximal end 36*a* and the distal end 36*b*. Chamber 62 surrounds a portion of suppressor 27.

Proximal end 36*a* includes aperture 13. Aperture 13 is sized and shaped to receive at least a portion of barrel 11 therethrough. Accordingly, proximal end 36*a* is in communication with a firearm through barrel 11. Proximal end 36*a* also includes first tapered structure 14. First tapered structure 14 is intended to reside adjacent to suppressor 27 when suppressor 27 is secured within proximal enclosure 36.

As best shown in FIG. 2, suppressor 27 is secured within proximal enclosure 36 when distal end 36*b* receives suppressor 27. Distal end 36*b* includes suppressor receiving envelope 50. A portion of suppressor 27 is inserted into suppressor receiving envelope Suppressor receiving envelope 50 includes lateral circumferential wall 53, which has a diameter slightly greater than a diameter of suppressor 27. As such, a seal is created between suppressor receiving envelope 50 and suppressor 27. Lateral circumferential wall 53 may be lined with rubber or a similar material to enhance the frictional retention of suppressor 27 within suppressor receiving envelope 50. Suppressor 27 includes bore which is sized and shaped to receive extension 37 of barrel 11. Extension 37 includes bore 12, which axially aligns with bore 30 of suppressor 27, allowing a projectile to enter suppressor 27 from barrel 11.

Referring now to FIGS. 1-4, chamber 62 is disposed between proximal end 36*a* and distal end 36*b*, such that chamber 62 surrounds suppressor 27. As such, chamber 62 is in fluid communication with suppressor 27. Upon firearm discharge, some of the residual effects emitted by suppressor 27 are captured by chamber 62. The residual effects are retained within chamber 62 by first tapered structure 14. Accordingly, chamber 62 and first tapered structure 14 are configured to dampen the residual effects noticeable exterior to the firearm.

As shown in FIGS. 1-2 and 5-6, shield 10 includes distal enclosure 18. Distal enclosure 18 includes a distal end 18*a*, chamber 61, and proximal end 18*b*, with a body disposed between distal end 18*a* and proximal end 18*b*. Distal end 18*a* includes projectile aperture 17, and allows for the discharge of a projectile fired from a firearm. Proximal end 18*b* is adapted to mate with suppressor 27, similar to the distal end 36*b* of proximal enclosure 36. Second tapered structure 19 and chamber 61 are disposed within the body and between distal end 18*a* and proximal end 18*b*.

Similar to distal end 36*b* of proximal enclosure 36, proximal end 18*b* of distal enclosure 18 includes suppressor receiving envelope 55. Suppressor 27 is inserted within suppressor receiving envelope 55, creating a seal between the structures. Suppressor receiving envelope 55 includes lateral circumferential wall 54, which may be lined with rubber or a similar material to aid in the frictional retention of suppressor 27.

Figure 6:
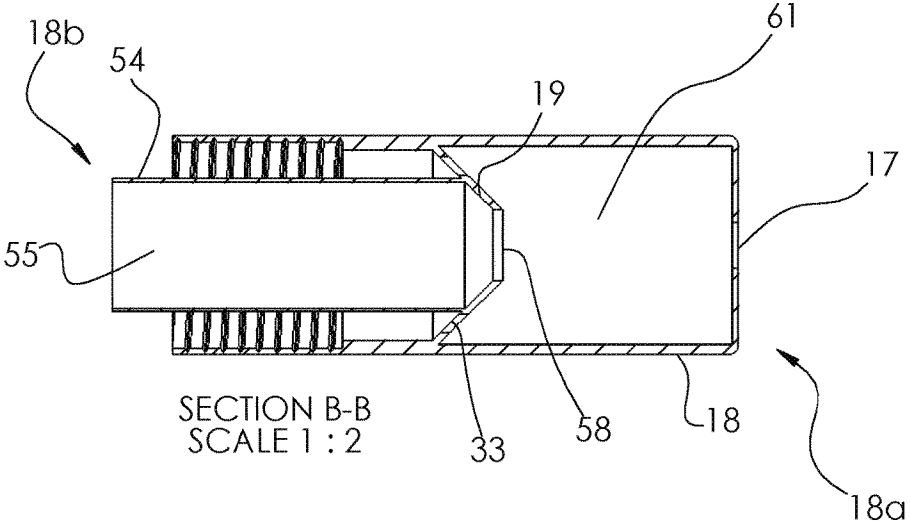
FIG. 6 is a section view of the distal enclosure of FIG. 5.
Figure 3:
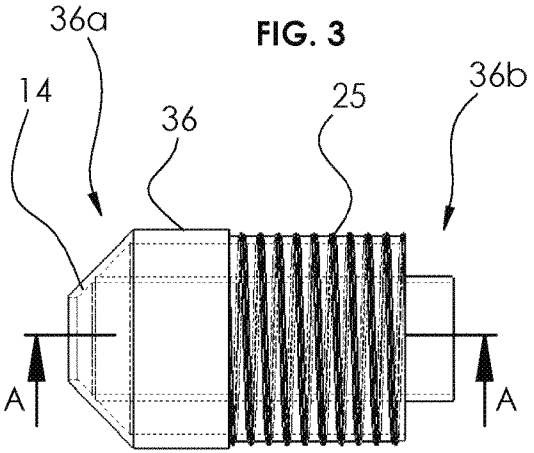
FIG. 3 is a side view of a proximal enclosure of the residual effect shield.
Figure 4:
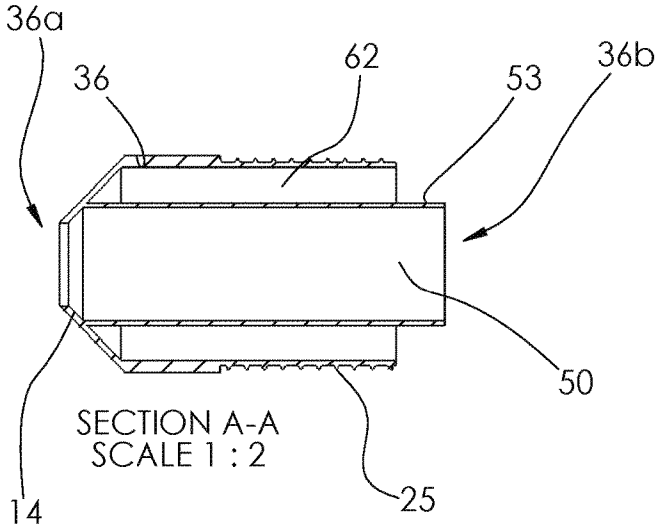
FIG. 4 is a section view of the proximal enclosure of FIG. 3.
Figure 7:
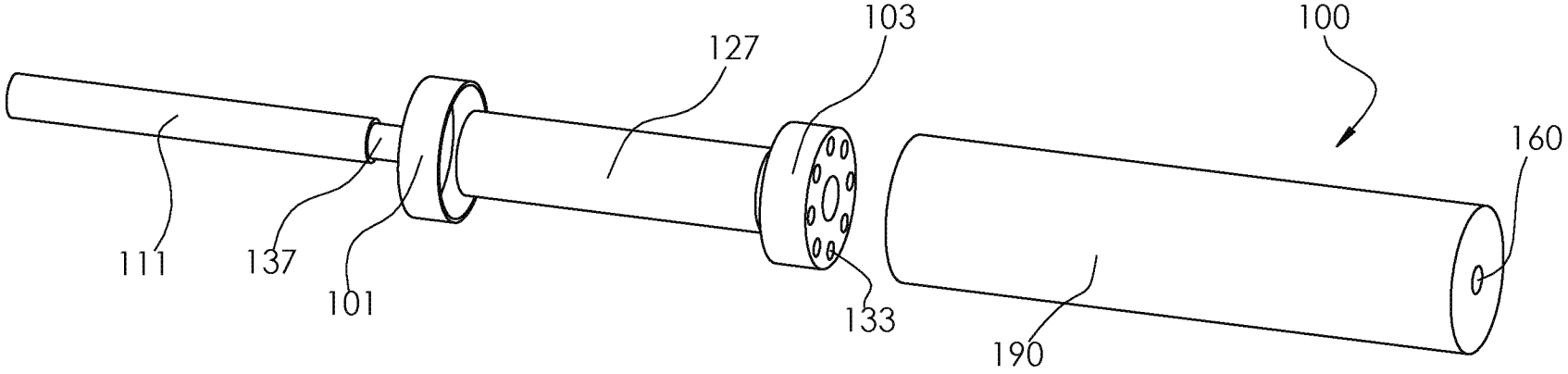
FIG. 7 is a partially disassembled view of a residual effect shield mounted on a firearm suppressor and a firearm barrel.

Distal enclosure 18 includes second tapered structure 19 and chamber 61. Second tapered structure 19 is intended to reside adjacent to suppressor 27 when suppressor 27 is secured within distal enclosure 18. Second tapered structure 19 has a proximal inner diameter that is greater than a distal inner diameter, creating a taper on second tapered structure 19. As such, second tapered structure 19 may be frustoconical in shape. In addition, the proximal inner diameter of second tapered structure 19 is greater than the diameter of a muzzle end of the firearm suppressor and the distal inner diameter is less or equal to the diameter of the muzzle end of the firearm suppressor. The shape of second tapered structure 19 aligns suppressor 27 with barrel 11, as second tapered structure 19 forces suppressor 27 into an axial alignment due to the tapered sides. Second tapered structure 19 includes bore 58, as shown in FIG. 6. When distal enclosure 18 couples with suppressor 27, bore 58 axially aligns with bore 31 on suppressor 27, thereby allowing a projectile to exit suppressor enter distal enclosure 18.

Second tapered structure 19 is longitudinally spaced from distal end 18*a* of distal enclosure 18, thereby creating chamber 61. Second tapered structure 19 is in fluid communication with chamber 61, such that some of the residual effects from discharge can translate between second tapered structure 19 and chamber 61. In particular, residual effects, such as gases, can disperse through second tapered structure 19 to chamber 61. To enhance the dispersion of residual effects into distal chamber 61, a plurality of fluid channels 33 are disposed on second tapered structure 19. Fluidic channels 33 provide fluid conduits through which gases and other residual effects can disperse. Some of the residual effects of the firearm discharge are dampened as the remaining sound, light, and heat energies are distributed throughout distal enclosure 18, in particular throughout chamber 61.

As shown in FIG. 1, proximal enclosure 36 threadedly engages with distal enclosure 18. Proximal enclosure 36 includes threading 25, best shown in FIG. 3. Distal enclosure includes threading 34, best shown in FIG. 5. Threading 25, 34 is complementary, such that proximal enclosure 36 mates with distal enclosure 18. When coupled, proximal and distal enclosures 36, 18 encase suppressor 27, providing space for the dispersion of the residual effects from firearm discharge. Threading 25, 34 allows for the adjustment of proximal and distal enclosures 36, 18 to accommodate suppressors 27 of varying dimensions. For example, proximal and distal enclosures 36, 18 can be adjusted to be closer together for a smaller suppressor, or can be further apart to accommodate a larger suppressor.

The exploded view of FIG. 2 depicts the alignment of proximal and distal enclosures 36, 18 with suppressor 27 and barrel 11. When suppressor 27 is inserted within suppressor receiver envelopes 50, 55, both proximal enclosure 36 and distal enclosure 18 axially align with suppressor 27, such that the components share a central axis. The alignment is fortified when proximal and distal enclosures 36, 18 threadedly engage. Further, shield aligns with barrel 11, thereby axially aligning projectile aperture 17 with barrel 11 and providing a channel for the uninterrupted lateral trajectory of a projectile during discharge. Accordingly, when shield 10 secures to suppressor 27, a projectile can exit a firearm via barrel 11; enter proximal enclosure 36; travel through suppressor 27; enter distal enclosure 18; and exit through projectile aperture 17.

Referring now to FIGS. 7-12, an embodiment of the shield, generally denoted by reference numeral 100, includes proximal enclosure 101 and distal enclosure 103. Proximal and distal enclosures 101, 103 are adapted to be at least partially encased within housing 190. Proximal enclosure 101 mates with barrel 111 of a firearm, such that extension 137 of barrel 111 is inserted within proximal enclosure 101. Similar to the components of shield described above, proximal and distal enclosures 101, 103 mate with suppressor 127.

Figure 8:
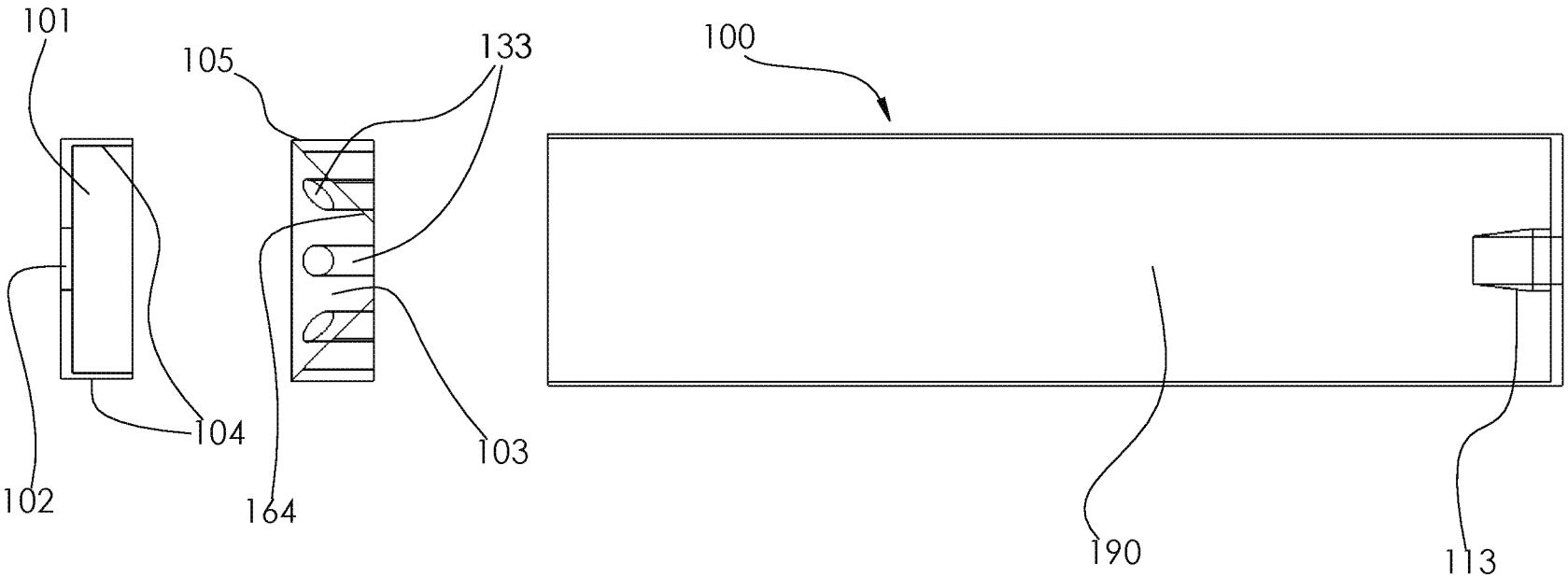
FIG. 8 is a disassembled view of the components of the residual effect shield of FIG. 7.
Figure 9:
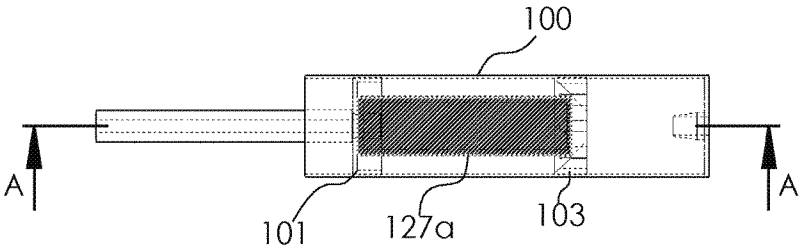
FIG. 9 is a side view of the residual effect shield of FIG. 7 mounted on a small firearm suppressor and a firearm barrel.
Figure 10:
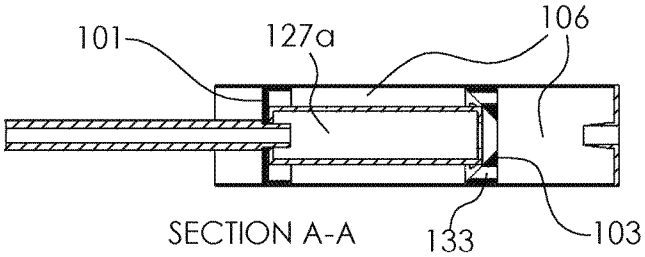
FIG. 10 is a section view of the residual effect shield of FIG. 9.
Figure 11:
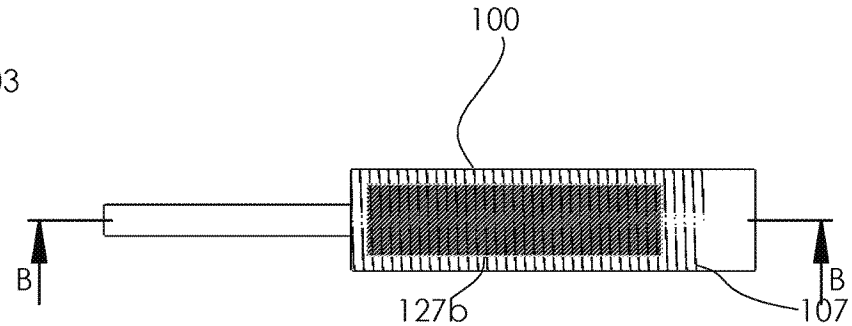
FIG. 11 is a side view of the residual effect shield of FIG. 7 mounted on a large firearm suppressor and a firearm barrel.
Figure 12:
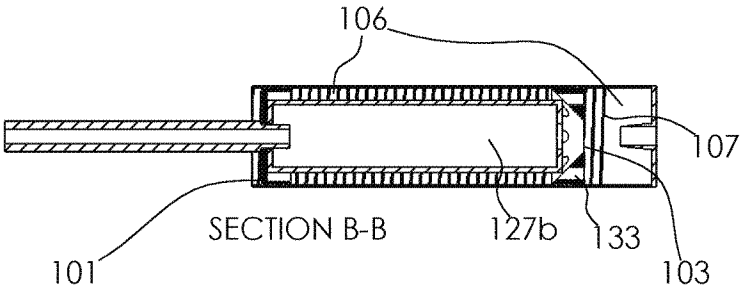
FIG. 12 is a section view of the residual effect shield of FIG. 11.
Figure 13:
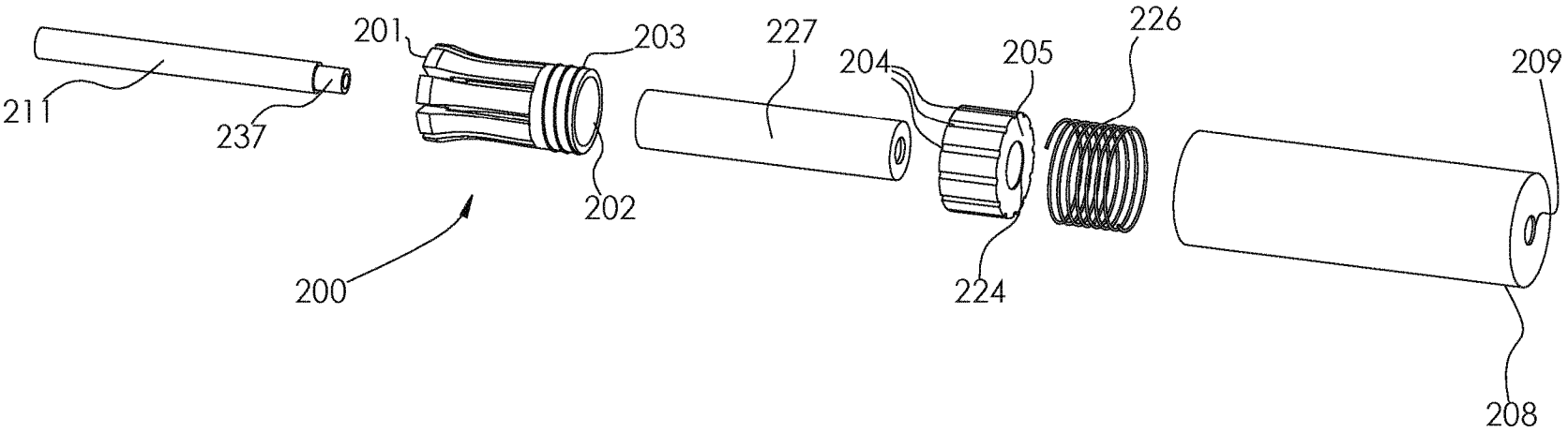
FIG. 13 is an exploded view of a residual effect shield mounted on a firearm suppressor and a firearm barrel.
Figure 18:
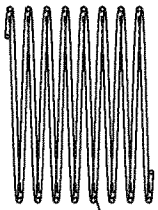
FIG. 18 is a side view of a compression spring, a component of the residual effect shield of FIG. 13.

As shown in FIGS. 8-9, proximal enclosure 101 includes mounting surface 104 and aperture 102. Mounting surface 104 includes a lateral circumferential wall, which has a diameter greater than the diameter of suppressor 127. As such, mounting surface 104 is adapted to engage with suppressor 127, with the lateral circumferential wall of mounting surface 104 engaging with an outer surface of suppressor 127. Mounting surface 104 is slidably adjustable in an axial direction with respect to suppressor 127, thereby accommodating suppressors of varying dimensions. For example, as shown in FIGS. 9-10, proximal enclosure 101 can accommodate a small suppressor 127*a*; similarly, as shown in FIGS. 11-12, proximal enclosure 101 can accommodate a large suppressor 127*b*. Aperture 102 provides a channel through which extension 137 of barrel 111 may be inserted, such that barrel 111 mates with suppressor 127. An outer surface of proximal enclosure 101 includes threading to couple proximal enclosure 101 to housing 190.

Similarly, distal enclosure 103 includes mounting surface 105 and tapered structure 164. Mounting surface 105 is adapted to engage with suppressor 127. Similar to mounting surface 104, mounting surface 105 is slidably adjustable in an axial direction with respect to suppressor 127. Tapered structure 164 is disposed adjacent to suppressor 127, and is frustoconical in shape, such that a distal end of tapered structure 164 has a greater diameter than a proximal end of tapered structure 164. The frustoconical shape of tapered structure 164 axially aligns suppressor 127 with a bore on tapered structure 164. Tapered structure 164 is longitudinally spaced from an end of housing 190. As shown in FIG. 10, the space between tapered structure 164 and the end of housing 190 creates chamber 106. Distal enclosure 103 also includes a plurality of fluidic channels 133 to allow for the dispersion of some of the residual effects into chamber 106. Fluidic channels 133 provide fluid conduits through which gases and other residual effects can disperse into chamber 106. Similar to proximal enclosure 101, an outer surface of distal enclosure 103 includes threading to couple distal enclosure 103 to housing 190.

As shown in FIGS. 7-8 and 11-12, housing 190 includes threading 107 on an interior lateral circumferential wall, projectile aperture 160, and interception device 113. Threading 107 is complementary to the threading on proximal and distal enclosure 101, 103, such that the enclosures threadedly engage with housing 190. As such, proximal and distal enclosures 101, 103 are securable to housing 190, forming shield 100. The lateral circumferential wall of housing 190 has a diameter that is slightly greater than the diameter of proximal and distal enclosures 101, 103, and much greater than the diameter of suppressor 127. The gap that exists between suppressor 127 and housing 190 creates and extension of chamber 106, allowing some of the residual effects to disperse directly from suppressor 127 into chamber 106.

Projectile aperture 160 of housing 190 allows for the exit of a projectile from a firearm during discharge. Accordingly, projectile aperture 160 is axially aligned with a center axis of barrel 111, allowing for the uninterrupted travel of a projectile from barrel 111 and through projectile aperture 160. Because chamber 106 is disposed adjacent to projectile aperture 160, it is possible that some of the residual effects from firearm discharge would escape through projectile aperture 160 into the environment exterior to the firearm. To prevent the escape of these residual effects through projectile aperture 160, housing 190 includes interception device 113. Interception device 113 is disposed adjacent to projectile aperture 160. When a projectile exits projectile aperture 160, the residual gas and light from the discharge are directed toward interception device 113. Interception device 113 has a distal end and proximal end, and is frustoconical in shape. As such, the distal end has a greater outer diameter than a diameter of the proximal end. The shape of interception device 113 directs gas, heat, and light away from projectile aperture 160, thereby redirecting the residual effects throughout chamber 106. The residual effects noticeable exterior to the firearm are reduced as a result of interception device 113.

To assemble shield 100, both barrel 111 and a proximal end of suppressor 127 are inserted within aperture 102 of proximal enclosure 101. As such, extension 137 of barrel 111 mates with suppressor 127, with proximal enclosure surrounding a portion of suppressor 127. A distal end of suppressor 127 engages with tapered structure 164 on distal enclosure 103, with the frustoconical shape of tapered structure 164 axially aligning suppressor 127 with barrel 111. Proximal and distal enclosures 101, 103 are inserted within housing 190, with housing 190 threadedly engaging with proximal and distal enclosures 101, 103. As shown in FIGS. 9-12, suppressor 127 is disposed within housing 190 when shield 100 is assembled. Distal enclosure 103 is longitudinally-spaced from projectile aperture 160, creating chamber 106. Further, chamber 106 extends throughout the space between suppressor 127 and housing 190. As such, gases and other residual effects from firearm discharge to disperse throughout chamber 106.

Referring now to FIGS. 13-21, an embodiment of the shield, generally denoted by reference numeral 200, is depicted. Shield 200 is adapted to ensleeve suppressor 227, thereby surrounding suppressor 227. In order to ensleeve suppressor 227, shield 200 includes enclosure 208, with includes compression sleeve 202, alignment partition 205, and spring 226. Compression sleeve 202 is adapted to engage with suppressor 227. Compression sleeve also engages with enclosure 208. Alignment partition 205 surmounts a portion of suppressor 227 and provides for adjustments of shield 200 to accommodate suppressors of varying dimensions. To provide for the dispersion of residual effects, shield 200 includes spring 226 that is disposed within enclosure 208 and adjacent to the projectile aperture end of enclosure 208. Spring 226 is biased to apply an axial force against alignment partition 205 in a direction toward barrel 211. The space created by the interaction between spring 226 and alignment partition 205 creates chamber 206, which is adapted to capture the residual effects of firearm discharge that are not absorbed by suppressor 227.

As shown in FIGS. 13-15 and 19-20, compression sleeve 202 is disposed adjacent to barrel 211 and ensleeves suppressor 227. Compression sleeve 202 includes a proximal end, a distal end, and a body extending therebetween. The proximal end includes at least one levered attachment arm 201 and aperture 222. The distal end is adapted to communicate with enclosure 208, and may include threading 203.

Figure 20:
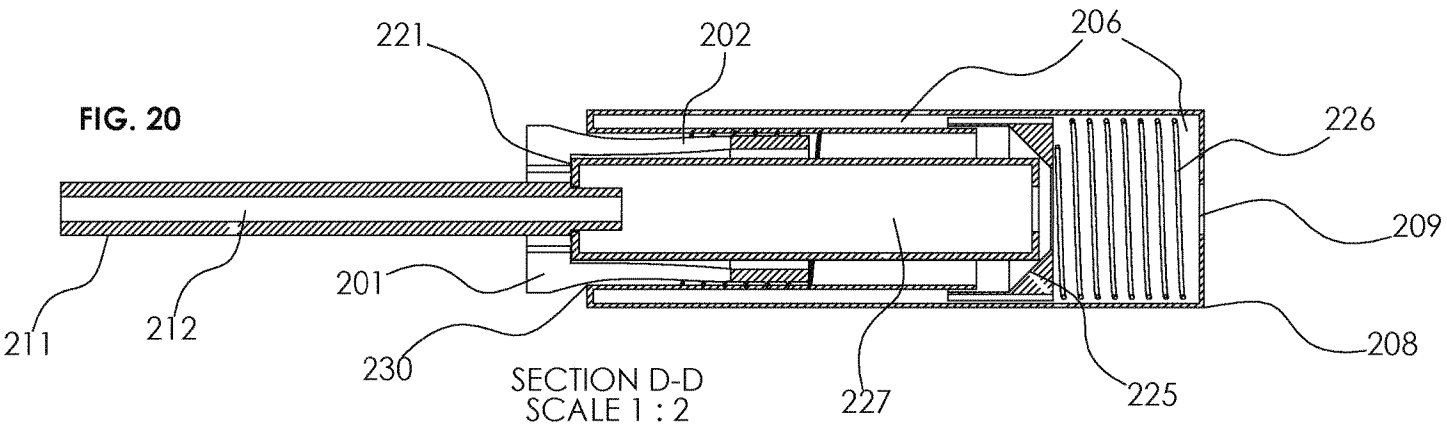
FIG. 20 is a section view of the residual effect shield of FIG. 19.

Attachment arm 201 axially extends in a direction away from the distal end of compression sleeve 202 and toward barrel 211. If more than one attachment arm 201 is included, the attachment arms 201 flare out and are disposed adjacent to suppressor 227. Attachment arm 201 is adapted to translate in a radial direction, such that attachment arm 201 is raised and lowered with respect to suppressor 227 when compression sleeve 202 surrounds suppressor 227. Attachment arm 201 translates within slots 220 in compression sleeve 202 when being radially translated. When lowered, attachment arm 201 rests against securement section 221 and attaches to a proximal end of suppressor 227. Accordingly, attachment arm 201 is adapted to grip suppressor 227, as shown in FIG. 20. By gripping suppressor 227, attachment arm 201 translates suppressor 227 in an axial direction toward the projectile aperture end of enclosure 208.

Referring now to FIGS. 13-14 and 19-21, enclosure 208 is shown in detail. Enclosure 208 includes a proximal end, a distal end, and a body disposed therebetween. The proximal end includes interior receipt 213, which extends along the body. The distal end includes projectile aperture 209. Chamber 206 disposed between interior receipt 213 and projectile aperture 209.

Interior receipt 213 includes inner walls 210, end wall 212, and compression surface 230. Inner walls 210 are disposed at the proximal end of enclosure 208 and extend axially toward the distal end of enclosure 208. At the proximal end of enclosure 208, inner walls 210 include compression surface 230. Compression surface is adapted to mate with another structure and apply a compression force against the structure. End wall 212 is coupled to inner walls 210, forming interior receipt 213. Therefore, end wall 212 is disposed within the body of enclosure 208. Threading 207 is disposed on inner walls 210; the placement of threading 207 will be discussed in greater detail below.

Threading 207 is complementary to threading 203 of compression sleeve 202. As such, compression sleeve 202 threadedly engages with interior receipt 213. As compression sleeve 202 axially translates toward end wall 212, engaging with threading 207, compression sleeve 202 contacts compression surface 230. Compression surface 230 is adapted to radially translate attachment arms 201 toward suppressor 227, such that attachment arms 201 grip suppressor 227. As enclosure 208 is rotated with respect to compression sleeve 202, compression surface 230 forces attachment arms 201 to grip suppressor 227 and axially translate suppressor 227 toward projectile aperture 209.

Figure 21:
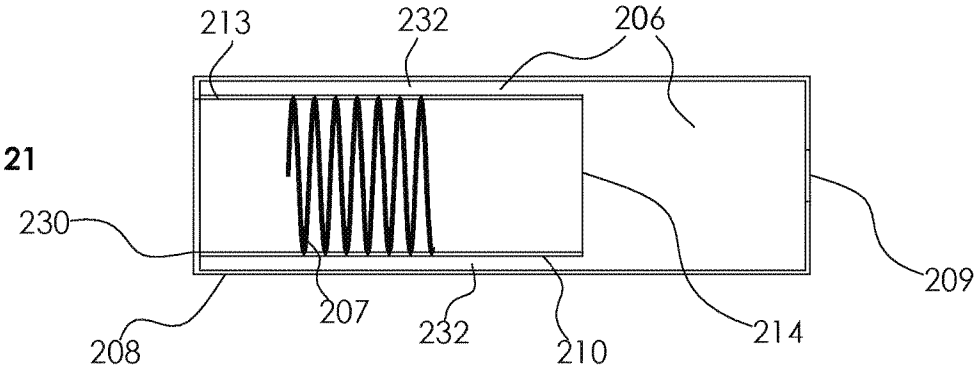
FIG. 21 is an interior view of an enclosure of the residual effect shield of FIG. 13.

As shown in FIG. 21, interior receipt 213 provides channels 232 for the translation of alignment partition 205. Inner walls 210 define an outer diameter, which is smaller than an inner diameter of enclosure 208. The space created by the difference between diameters creates channels 232 along the exterior surface of interior receipt 213.

A portion of chamber 206 is disposed between projectile aperture 209 and end wall 212. Chamber 206 provides a space for the dispersion of residual effects resulting from firearm discharge. Chamber 206 will be discussed in greater detail below.

As shown in FIGS. 13, 16, and 19-20, shield 200 includes alignment partition 205. Alignment partition is disposed within the body of enclosure 208, and is longitudinally-spaced from the distal end of enclosure 208. Alignment partition 205 includes tapered structure 225, fluidic channels 204, and aperture 224.

Figure 19:
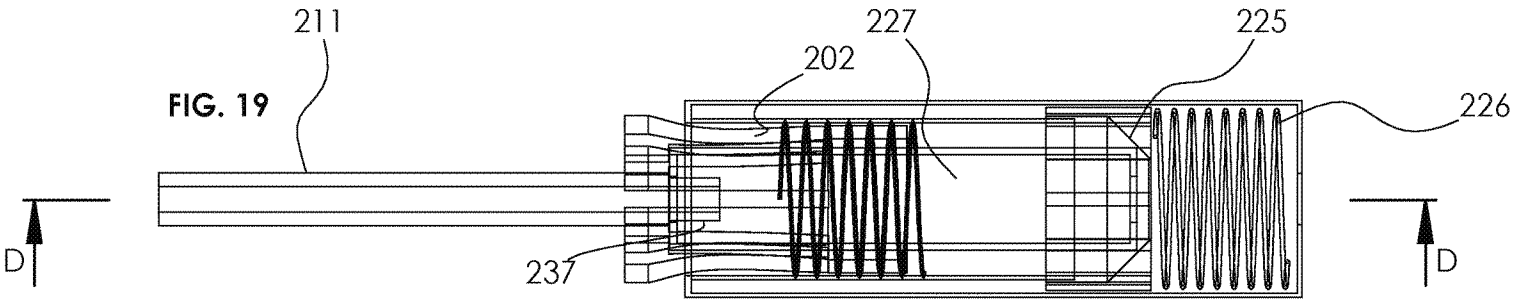
FIG. 19 is a side view of the residual effect shield of FIG. 13 mounted on a firearm suppressor and a firearm barrel.

As depicted in FIGS. 19-20, Alignment partition 205 is adapted to be disposed between end wall 212 and the projectile aperture end of enclosure 208. Alignment partition 205 is adapted to surround a portion of interior receipt 213. As such, alignment partition 205 includes an inner diameter that is slightly greater than the outer diameter of interior receipt 213, but less than the inner diameter of enclosure 208. Alignment partition 205 thereby resides within enclosure 208 while also surrounding interior receipt 213. As shown in FIGS. 19-21, alignment partition 205 can axially translate along interior receipt 213 via channels 232. As such, the location of alignment partition 205 can be adjusted about the length of inner walls 210 to accommodate suppressors of varying lengths. End wall 212 of interior receipt 213 provides a stopping surface for alignment partition 205, such that alignment partition 205 cannot axially translate past end wall 212 toward barrel 211.

Still referring primarily to FIGS. 19-20, tapered structure 225 of alignment partition 205 mates with a distal end of suppressor 227, such that suppressor 227 rests against tapered structure 225. tapered structure 225 is frustoconical in shape such that it aligns suppressor 227 with aperture 224. The frustoconical shape of tapered structure 225 can also increase the dampening of the residual effects of gunfire. When compression sleeve 202 engages with enclosure 208, compression sleeve 202 and alignment partition 205 compress against the ends of suppressor 227. Alignment partition 205 exerts a force against suppressor 227 in an axial direction toward barrel 211. Similarly, compression sleeve 202 axially pulls suppressor 227 toward projectile aperture 209, as discussed above. As such, compression sleeve 202 and alignment partition 205 exert axial forces against suppressor 227 in opposite directions, such that shield 200 grips both ends of suppressor 227. The forces exerted by compression sleeve 202 and alignment partition 205 also axially align suppressor 227 with barrel 211 and projectile aperture 209.

Figure 17:
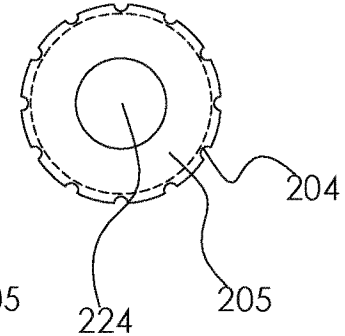
FIG. 17 is an end view of the alignment partition of FIG. 16.
Figure 16:
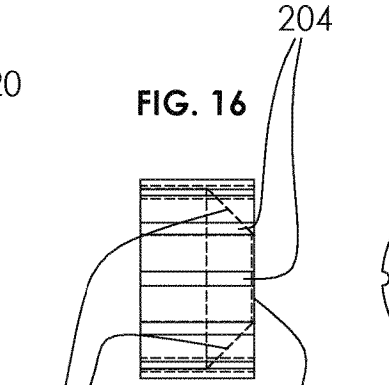
FIG. 16 is a side view of an adjustable alignment partition on the residual effect shield of FIG. 13.
Figure 15:
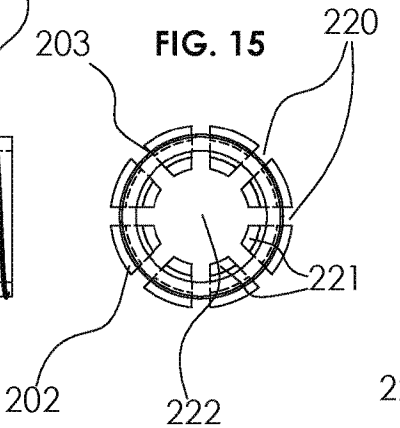
FIG. 15 is an end view of the compression sleeve of FIG. 14.
Figure 14:
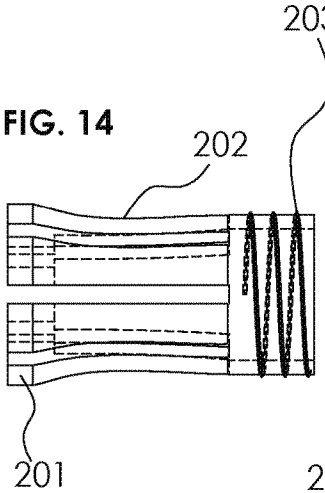
FIG. 14 is a side view of a compression sleeve on the residual effect shield of FIG. 13.

As shown in FIGS. 16-17, alignment partition 205 also includes fluidic channels 204, allowing some of the residual effects to disperse into chamber 206 through the fluidic channels 204. Aperture 224 axially aligns with suppressor 227, such that a projectile can exit alignment partition 205 and travel toward the projectile aperture end of enclosure 208.

As shown in FIGS. 13 and 18-20, shield 200 includes spring 226. Spring 226 is disposed against the distal end of enclosure 208, adjacent to projectile aperture 209, when shield 200 mates with suppressor 227. Spring 226 is in communication with alignment partition 205, such that alignment partition 205 at least partially compresses spring 226 when shield 200 mates with suppressor 227. Spring 226 also forces alignment partition 205 toward suppressor 227, thereby aligning suppressor 227 with barrel 211. Together with compression sleeve 202, spring 226 ensures that suppressor 227 is secured in place within shield 200.

The interaction between spring 226 and alignment partition 205 creates chamber 206, which receives some of the residual effects of firearm discharge. The size of chamber 206 is determined by the compression of spring 226, which in turn is determined by the location of suppressor 227 within enclosure 208. The location of suppressor 227 is determined by the interaction between compression sleeve 202 and interior receipt 213. Specifically, the engagement between compression sleeve 202 and threading 207 causes suppressor 227 to axially translate away from barrel 211. The axial translation of suppressor 227 compresses spring 226. To ensure that spring 226 does not compress so much that chamber 206 is not created, threading 207 is disposed on a middle portion of interior receipt 213.

As shown in FIGS. 19-20, each of the components of shield 200 function to axially align barrel 211 with projectile aperture 209 of enclosure 208, such that a projectile can be fired through barrel 211 and exit through projectile aperture 209. Extension 237 of barrel 211 is inserted within compression sleeve 202. Barrel 211 mates with suppressor 227 within compression sleeve 202, such that extension 237 is inserted within suppressor 227. As such, suppressor 227 has an inner diameter that is slightly greater than the outer diameter of extension 237, so that suppressor 227 can receive extension 237. The difference between the diameters of suppressor 227 and extension 237 is best shown in FIG. 20, wherein reference numeral 212 generally describes the bore of barrel 211. The interaction described above between attachment arm 201, suppressor 227, alignment partition 205, and spring 226 causes shield 200 to axially align with suppressor 227. As such, barrel 211, suppressor 227, and shield 200 axially align, such that projectile aperture 209 aligns with bore 212 of barrel 211. The axial alignment of the component parts of shield 200 with suppressor 227 and barrel 211 provides a channel through which a projectile can be discharged.

Figure 22:
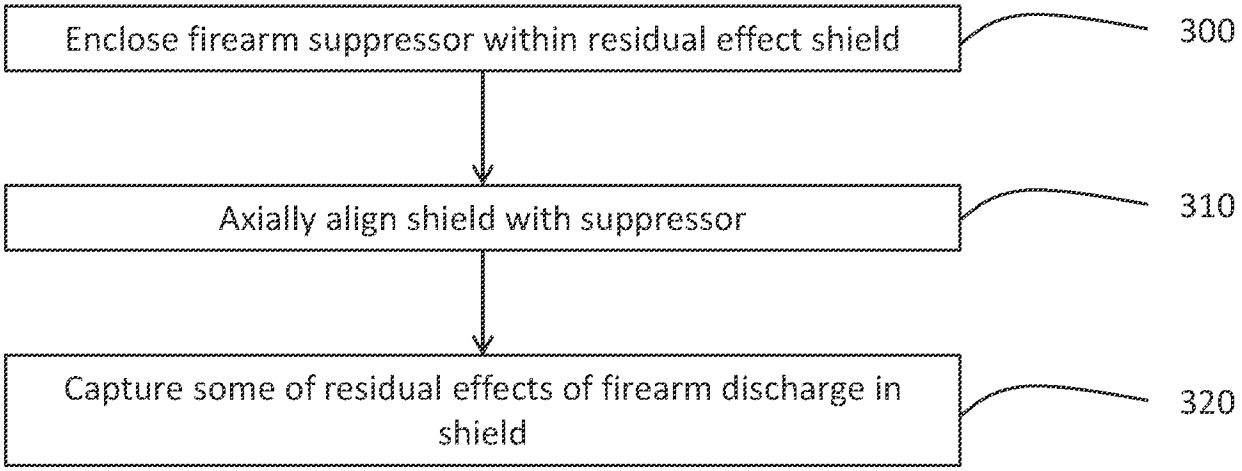
FIG. 22 is a process-flow diagram of a method of dampening the residual effects of a firearm discharge from a firearm suppressor.

Referring now to FIG. 22, in conjunction with FIGS. 13-21, an exemplary process-flow diagram is provided, depicting a method of dampening the residual effects of a firearm discharge from a firearm suppressor. The steps delineated in the exemplary process-flow diagram of FIG. 22 are merely exemplary of an order of dampening residual effects using an embodiment of a shield. The steps may be carried out in another order, with or without additional steps included therein. Additionally, the steps may be carried out with an alternative embodiment of a shield, as contemplated in the description above.

The method of dampening residual effects of firearm discharge begins at step 300, which includes enclosing firearm suppressor 227 within shield 200. Suppressor 227 is mated to a portion of barrel 211, such as extension 237. Shield 200 includes a proximal portion opposite a distal portion. The distal portion includes projectile aperture 209 and tapered structure 225. Tapered structure 225 is longitudinally-spaced from projectile aperture 209, such that tapered structure 225 is disposed between projectile aperture 209 and barrel 211. Tapered structure 225 has a proximal inner diameter that is greater than a distal inner diameter.

The method proceeds to step 310, which includes aligning shield 200 with suppressor 227. The alignment is step is accomplished by axially forcing barrel 211 into shield 200, such that suppressor 227 engages with tapered structure 225 disposed at the distal portion of shield 200. By forcing suppressor 227 to engage with tapered structure 225, suppressor 227 funnels into alignment with shield 200.

When shield 200 couples to suppressor 227, shield 200 substantially surrounds suppressor 227. Upon a firearm discharge, a portion of the effects of the discharge are captured by suppressor 227. However, suppressor 227 may not capture all of the effects from discharge, leaving residual effects that either escape the firearm, or are retained by another component. Shield 200 is adapted to capture at least some of the residual effects of the discharge. During step 320, some of the residual effects from discharge are dispersed throughout shield 200. As such, shield 200 dampens the residual effects noticeable in the environment exterior to the firearm.

Figure 23:
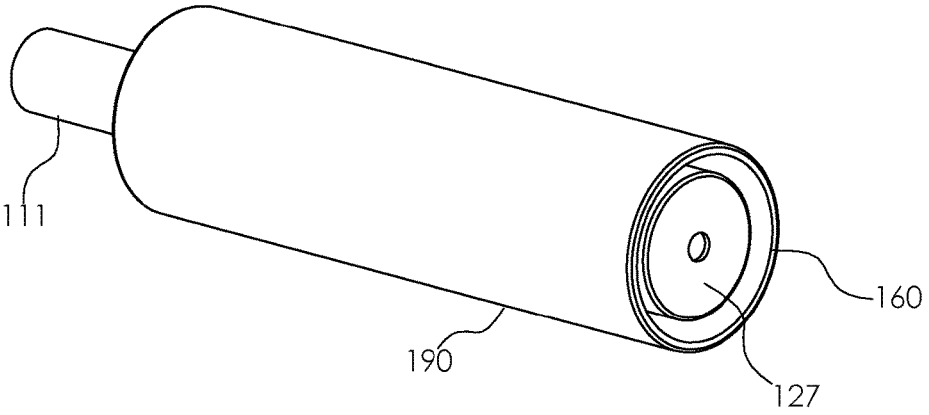
FIG. 23 is a perspective view of an embodiment of a residual effect shield mounted on a firearm suppressor and a firearm barrel.
Figure 24:
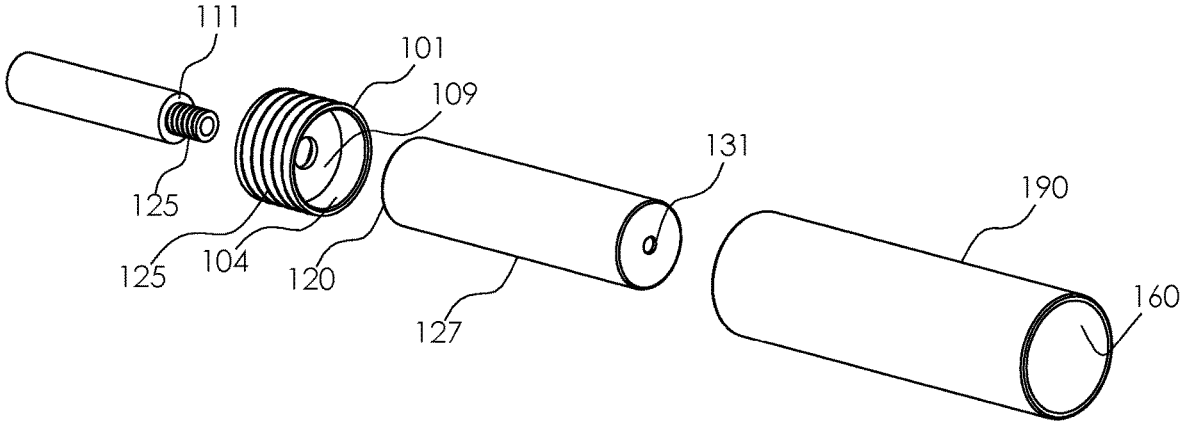
FIG. 24 is an exploded vie of the embodiment depicted in FIG. 23.
Figure 25:
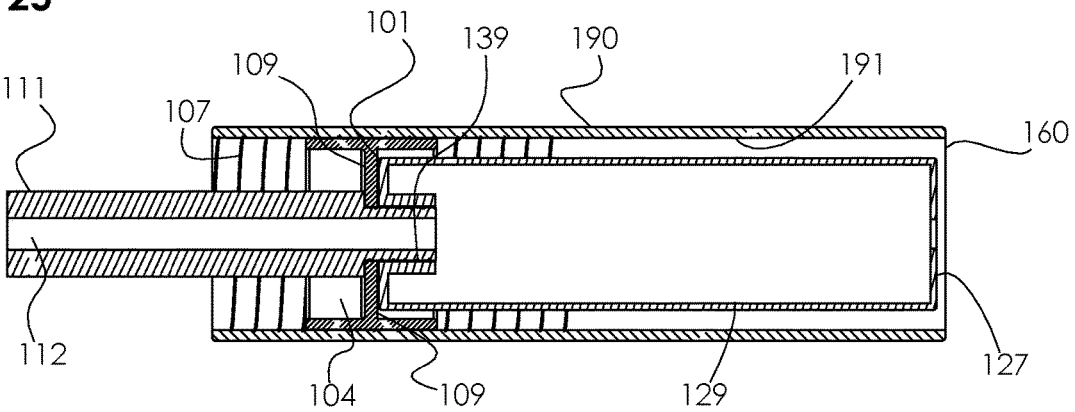
FIG. 25 is a sectional view of the embodiment depicted in FIG. 23.

Referring now to FIGS. 23-25, a variation of shield 100 does not include distal enclosure 103 as depicted in FIGS. 7-12. In addition, the embodiment depicted in FIGS. 23-25 includes a much larger projectile aperture 160 that is generally the same diameter as housing 190. Similar to the embodiment depicted in FIGS. 7-12, proximal enclosure 101 encircles threaded extension 137 of firearm barrel 111 and can be secured in place when suppressor 127 threadedly engages threaded extension 137 and sandwiches radial wall 109 against the barrel shoulder. In an embodiment, proximal enclosure 101 includes internal threads to engage threaded extension 137.

As shown in FIGS. 24-25, proximal enclosure 101 includes mounting surface 104 and aperture 102. Mounting surface 104 is a lateral circumferential wall, which has a diameter greater than the diameter of suppressor 127 and extends in an axial direction. In addition, mounting surface 104 of proximal enclosure 101 includes threading 125 to couple proximal enclosure 101 to housing 190, which includes its own internal threading 107 located on an interior lateral circumferential wall. Threading 107 is configured to engage threading 125.

Housing 190 further includes an internal diameter greater than the outer diameter of suppressor 127, thereby ensuring that internal lateral surface 191 does not contact external lateral surface 129 to prevent conductive heat transfer from suppressor 127 to housing 190. Elimination of conductive heat transfer between the outer lateral surface of suppressor 127 (the hottest area of the suppressor) and the interior lateral surface of housing 190 substantially reduces the risk of the firearm operator burning him/herself from incidental contact with housing 190. Moreover, the gap that exists between suppressor 127 and housing 190 establishes a chamber to allow some of the residual effects to disperse within the chamber.

An embodiment may include other forms and methods known to a person of ordinary skill in the art to attach housing 190 to proximal enclosure 101 other than via a threaded engagement, including those disclosed herein. In an embodiment, housing 190 is integrated with proximal enclosure 101.

Projectile aperture 160 of housing 190 allows for the exit of a projectile from a firearm during discharge. Accordingly, projectile aperture 160 is axially aligned with a center axis of barrel 111, allowing for the uninterrupted travel of a projectile from barrel 111 and through projectile aperture 160. Moreover, projectile aperture 160 has a diameter greater than the outer diameter of suppressor 127 such that larger suppressors can extend out of the distal end of housing 190 while housing 190 is able to still encircle a majority of suppressor 127 to protect oneself from accidentally contacting an extremely hot outer lateral surface of suppressor 127. Projectile aperture 160, however, preferably has a diameter less than the diameter of internal sleeve 402 to ensure that internal sleeve 402 remains within housing 190 (see FIGS. 26-28).

Figure 26:
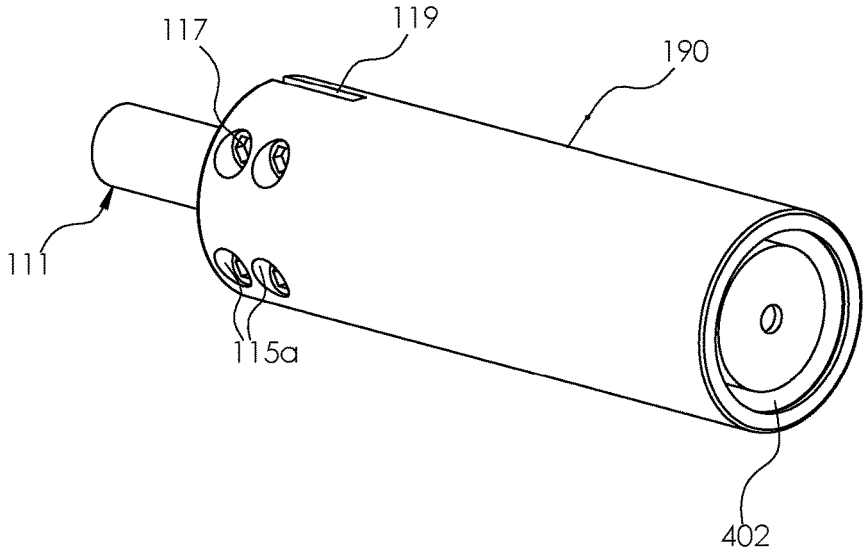
FIG. 26 is a perspective view of an embodiment of a residual effect shield mounted on a firearm suppressor and a firearm barrel.
Figure 27:
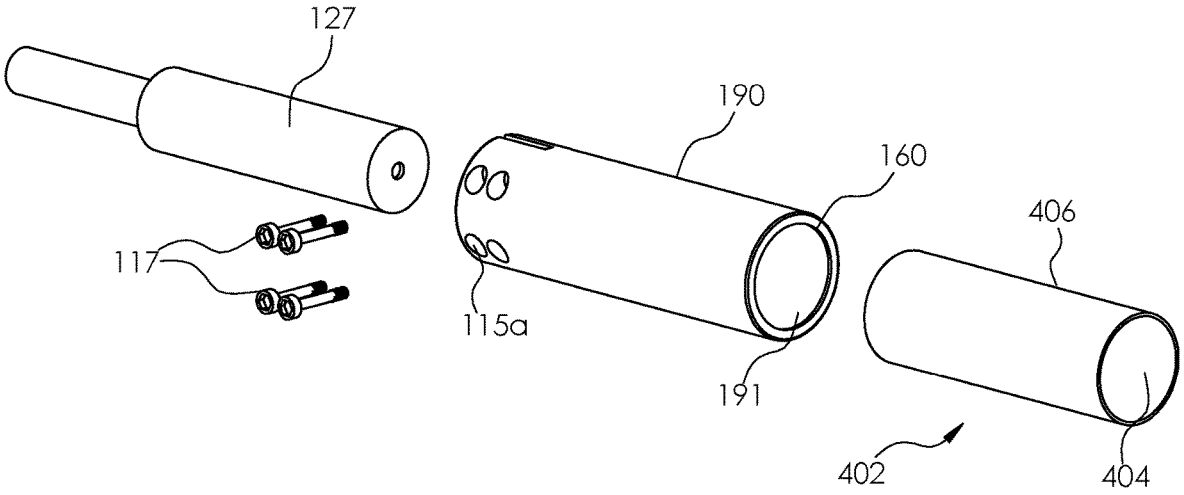
FIG. 27 is an exploded view of the embodiment depicted in FIG. 26.
Figure 28:
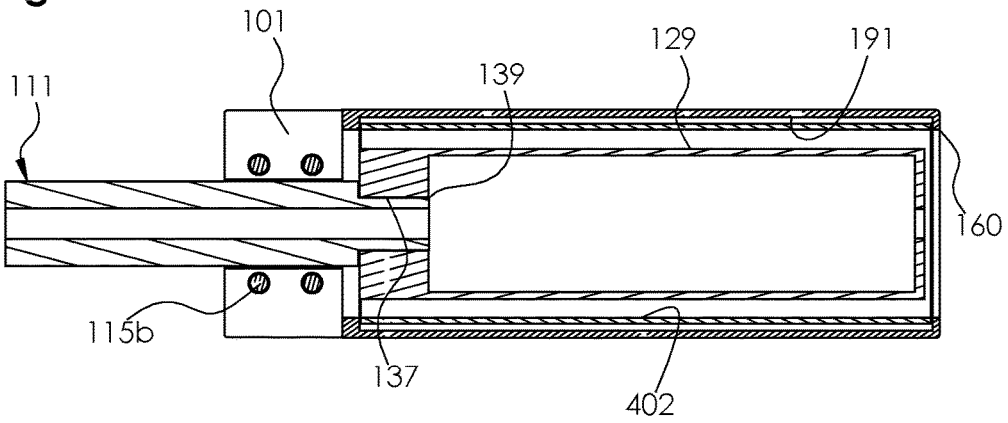
FIG. 28 is a sectional view of the embodiment depicted in FIG. 26.

Referring now to FIGS. 26-28, an embodiment of the shield includes proximal enclosure 101 integrated with housing 190. Housing 190 and proximal enclosure 101 includes at least one longitudinally extending slot 119 to allow housing 190 and anchor 101 to flex inwards to contract around firearm barrel 111. In an embodiment, fasteners 117 pass through fastener apertures 115*a* disposed through one half of housing 190 and threadedly engage threaded apertures 115*b* on the other half of housing 190. Slot 119 and apertures 115 are oriented such that fastener 117 can pull the opposite sides of the slot towards one another to reduce the internal diameter or perimeter of housing 190 and proximal enclosure 101.

An embodiment may include other forms and methods known to a person of ordinary skill in the art to attach proximal enclosure 101 to firearm barrel 111, including those disclosed herein. For example, proximal enclosure 101 or may include a central threaded bore to engage threads 139 on extension 137. In an embodiment, housing 190 is removably attachable to proximal enclosure 101.

FIGS. 26-28 also depict the use of an interior insulative or reflective sleeve 402. Sleeve 402 may be comprised of alloys, polymers, ceramics, glass fibers, fiberglass fabrics, aluminized fabrics, silica fabrics, PAN fabrics, Polyacrylonitrile, ceramic fabrics, textiles, rubber, mesh textiles, reflective materials, or other insulating materials. Moreover, the sleeve could be porous and/or have internally facing reflective surfaces (e.g., alloys can be polished to reflect heat, or a reflective surface can be applied to the inner surfaces) to aid in preventing the transfer of heat to the outer housing.

In some embodiments, interior sleeve 402 has an outer diameter greater than the diameter of projectile aperture 160 to ensure that internal sleeve 402 remains within housing 190. In an embodiment, interior sleeve 402 is attachable or integrated with outer housing 190. In some embodiments, sleeve 402 is secured to internal surface 191 of housing 190. Sleeve 402 may be secured to internal surface 191 via any methods and devices known to a person of ordinary skill in the art, including but not limited to adhesives, hook and loop fasteners, clamps, and threads. Preferably the adhesive and other attachment mechanisms are heat resistant to at least 180 degrees Fahrenheit. In some embodiments, the adhesive and other attachment mechanisms are heat resistant to at least 900 degrees Fahrenheit.

Alternatively, sleeve 402 is not secured to internal surface 191 of housing 190. Rather, sleeve 402 is sandwiched between internal surface 191 of housing 190 and the outer surface 129 of suppressor 127.

In some embodiments, interior sleeve 402 includes an internal diameter greater than the outer diameter of suppressor 127, thereby ensuring that internal lateral surface 404 does not contact external lateral surface 129 of suppressor 127 to prevent conductive heat transfer from suppressor 127 to housing 190. Elimination of conductive heat transfer between the outer lateral surface of suppressor 127 (the hottest area of the suppressor) and the interior lateral surface of interior sleeve 402 substantially reduces the risk of the firearm operator burning him/herself from incidental contact with housing 190.

In some embodiments, interior sleeve 402 further includes an external diameter less than the internal diameter of housing 190, thereby creating a chamber between interior sleeve 402 and housing 190. This chamber ensures that external lateral surface 406 does not contact internal lateral surface 191 of housing 190 to prevent conductive heat transfer from interior sleeve 402 to housing 190. Elimination of conductive heat transfer between the interior sleeve 402 and housing 190 further reduces the risk of significant heat being transferred to housing 190.

Another embodiment of the shield is depicted in FIGS. 29-32, which includes proximal enclosure 101 in the form of a two-part anchor, fabric interior sleeve 402, dimpled housing 190, and a protrusion based locking feature comprised of protrusion 121 and locking passage 119. Proximal enclosure 101 includes first half 101*a* configured to attached to second half 101*b* and constrict around firearm barrel 111 through fasteners 117. Fasteners 117 pass through fastener apertures 115*a* disposed through half 101*a* and threadedly engage threaded apertures 115*b* on half 101*b*. Fasteners 117 pull the two halves towards one another to reduce the internal diameter or perimeter of proximal enclosure 101 to clamp proximal enclosure 101 onto barrel 111. An embodiment may include other forms and methods known to a person of ordinary skill in the art to attach proximal enclosure 101 to firearm barrel 111, including those disclosed herein. For example, proximal enclosure 101 or may include a central threaded bore to engage threads 139 on extension 137 or a cam-actuated clamp (not shown) can reduce the internal diameter of proximal enclosure 101 to clamp around barrel 111.

Proximal enclosure 101 further includes at least one protrusion 121 that has a size and shape to be received within locking passage 119 disposed in housing 190. Locking passage 119 is shaped to receive housing 190 as housing 190 is moved in a first longitudinal direction and can be rotated about the longitudinal axis to prevent housing 190 from being pulled in an opposite second longitudinal direction to disconnect housing 190 from proximal enclosure 101. As depicted, locking passage 119 has a generally L-shaped pattern.

An embodiment, however, may include any shaped locking passage that requires at least some rotation of the housing about the longitudinal axis to prevent housing 190 from being pulled in an opposite second longitudinal direction to disconnect housing 190 from proximal enclosure 101. In an embodiment, protrusion 121 is disposed on housing 190 and locking passage 119 is disposed in proximal enclosure 101. In an embodiment, protrusion 121 is a spring biases detent and locking passage 119 is an orifice sized to receive the detent.

Proximal enclosure 101 further includes separation projections 123 to space proximal enclosure 101 away from suppressor 127 in a longitudinal direction. Separation projections 123 are disposed on a distal end of proximal enclosure 101 and extend distally therefrom in a longitudinal direction. Separation projections 123 thus create spacing and limit conduction between the proximal end of suppressor 127 and proximal enclosure 101. The number and shapes of separation projections 123 may differ between embodiments.

The embodiment depicted in FIGS. 29-32 also includes an interior sleeve 402 comprised of thermal insulating fabric to further prevent heat transfer between suppressor 127 and housing 190. Fabric typically retain less heat and is less effective at transferring heat than other materials. It is considered, however, that an embodiment may employ sleeve 402 made of any insulating material and in accordance with any variation of sleeve 402 described herein.

In the depicted embodiment, interior sleeve 402 has an outer diameter greater than the diameter of projectile aperture 160 to ensure that internal sleeve 402 remains within housing 190. In an embodiment, interior sleeve 402 is attachable or integrated with outer housing 190. Interior sleeve 402 further includes an internal diameter greater than the outer diameter of suppressor 127, thereby ensuring that internal lateral surface 404 does not contact external lateral surface 129 of suppressor 127 to prevent conductive heat transfer from suppressor 127 to housing 190. Elimination of conductive heat transfer between the outer lateral surface of suppressor 127 (the hottest area of the suppressor) and the interior lateral surface of interior sleeve 402 substantially reduces the risk of the firearm operator burning him/herself from incidental contact with housing 190.

In an embodiment, interior sleeve 402 further includes an external diameter less than the internal diameter of housing 190, thereby creating a chamber between interior sleeve 402 and housing 190. This chamber ensures that external lateral surface 406 does not contact internal lateral surface 191 of housing 190 to prevent conductive heat transfer from interior sleeve 402 to housing 190. Elimination of conductive heat transfer between the interior sleeve 402 and housing 190 further reduces the risk of significant heat being transferred to housing 190.

Housing 190 also includes dimples 192 or other features to create a discontinuous outer surface. Dimples 192 create a recessed area 126 closer to the interior surface of housing 190. Recessed area 126 receives internal heat quicker than the outermost surface of housing 190 and can more quickly transfer the heat to the ambient environment. In addition, the recessed dimples increase the surface area open to the ambient environment, which also allows for greater heat transfer to the environment and reduces the area that could accidentally come in contact with a shooter. As a result, dimples 192 reduce the amount of heat transferred to the shooter when housing 190 is accidentally contacted by the shooter. The dimples may be any size, shape and depth.

Referring now to FIGS. 33-37, an embodiment of the shield includes two internal sleeves 402 and 502, ridged housing 190, and proximal enclosure 101 in the form of a slotted, threaded anchor to which housing 190 can connect. Internal sleeve 402 is an insulating sleeve disposed between housing 190 and suppressor 127. In the depicted embodiment, internal sleeve 402 includes a plurality of holes disposed through the lateral surface to aid in heat dispersion.

Internal sleeve 402 further includes an internal diameter greater than the outer diameter of suppressor 127, thereby ensuring that internal lateral surface of sleeve 402 does not contact the external lateral surface of suppressor 127 to prevent conductive heat transfer from suppressor 127 to housing 190. Elimination of conductive heat transfer between the outer lateral surface of suppressor 127 (the hottest area of the suppressor) and the interior lateral surface of interior sleeve 402 substantially reduces the risk of the firearm operator burning him/herself from incidental contact with housing 190.

Middle sleeve 502 is disposed between interior sleeve 402 and housing 190. In an embodiment, sleeve 502 is made of fabric, however, it could be made of any other insulative or reflective barriers. Sleeve 502 provides an additional barrier to prevent heat transfer to housing 190.

Both interior sleeve 402 and middle sleeve 502 have outer diameters greater than the diameter of projectile aperture 160 to ensure that sleeves 402, 502 remain within housing 190. In an embodiment, sleeves 402, 502 may be attachable to or integrated with housing 190.

In the depicted embodiment, housing 190 includes a plurality of ridges 193 rather than dimples. Ridges 193 provide the same benefits as the dimples—greater heat transfer to the environment through an increased surface area open to the ambient environment and reduced accidental contact area. As a result, ridges 193 reduce the amount of heat transferred to the shooter when housing 190 is accidentally contacted by the shooter. The ridges may be any size, shape and depth.

Proximal enclosure 101 is in the form of a slotted, threaded anchor. Slot 119 has a width large enough to receive the diameter of firearm barrel 111. Thus proximal enclosure 101 can be secured to barrel 111 without having to first remove suppressor 127. Like previous embodiments, longitudinally extending slot 119 also allows proximal enclosure 101 to flex inwards to contract around firearm barrel 111. In an embodiment, fasteners 117 pass through fastener apertures 115*a* disposed through one half of housing 190 and threadedly engage threaded apertures 115*b* on the other half of housing 190. Slot 119 and apertures 115 are oriented such that fastener 117 can pull the opposite sides of the slot towards one another to reduce the internal diameter or perimeter of proximal enclosure 101.

An embodiment may include other forms and methods known to a person of ordinary skill in the art to attach proximal enclosure 101 to firearm barrel 111, including those disclosed herein. For example, proximal enclosure 101 or may include a central threaded bore to engage threads 139 on extension 137.

As depicted, the embodiment in FIGS. 33-37 includes threads 125 disposed on an outer lateral surface of proximal enclosure 101 to engage threads (not shown) disposed on an interior surface of housing 190. The threaded engagement connects housing 190 to proximal enclosure 101. An embodiment may include other forms and methods known to a person of ordinary skill in the art to attach housing 190 to proximal enclosure 101 other than via a threaded engagement, including those disclosed herein. In an embodiment, housing 190 is integrated with proximal enclosure 101.

The depicted proximal enclosure 101 further includes tapered section 139 at its distal end which engages oppositely tapered section 197 proximate the proximal end of housing 190. In addition, the proximal end of housing 190 includes tapered section 199 which engages oppositely tapered section 141 on the proximal end of proximal enclosure 101. The combination of these tapered engagements between proximal enclosure 101 and housing 190 helps to longitudinally align housing 190 with respect to the longitudinal axis of proximal enclosure 101. An embodiment may employ only one tapered engagement rather than both described above.

Proximal enclosure 101 further includes a plurality of chambers 131 to allow for airflow to and from suppressor 127. The increased airflow helps to dissipate heat to the environment and further reduce heat transfer to housing 190.

Figure 38:
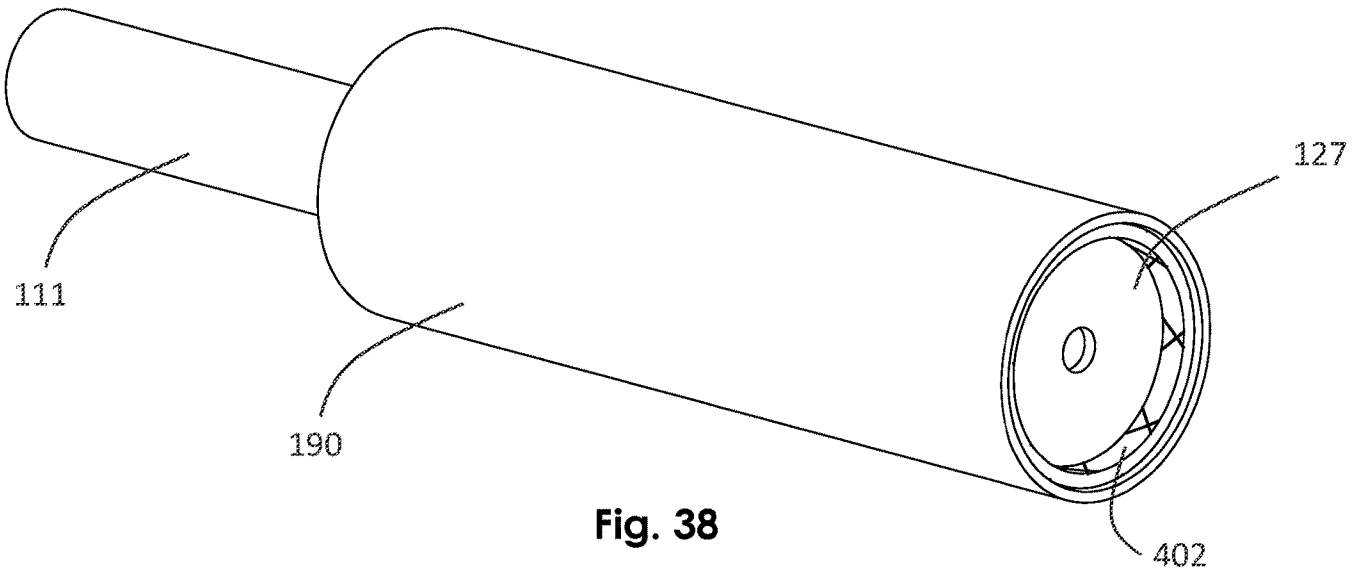
FIG. 38 is a perspective view of an embodiment of present invention mounted on a firearm suppressor and a firearm barrel.
Figure 39:
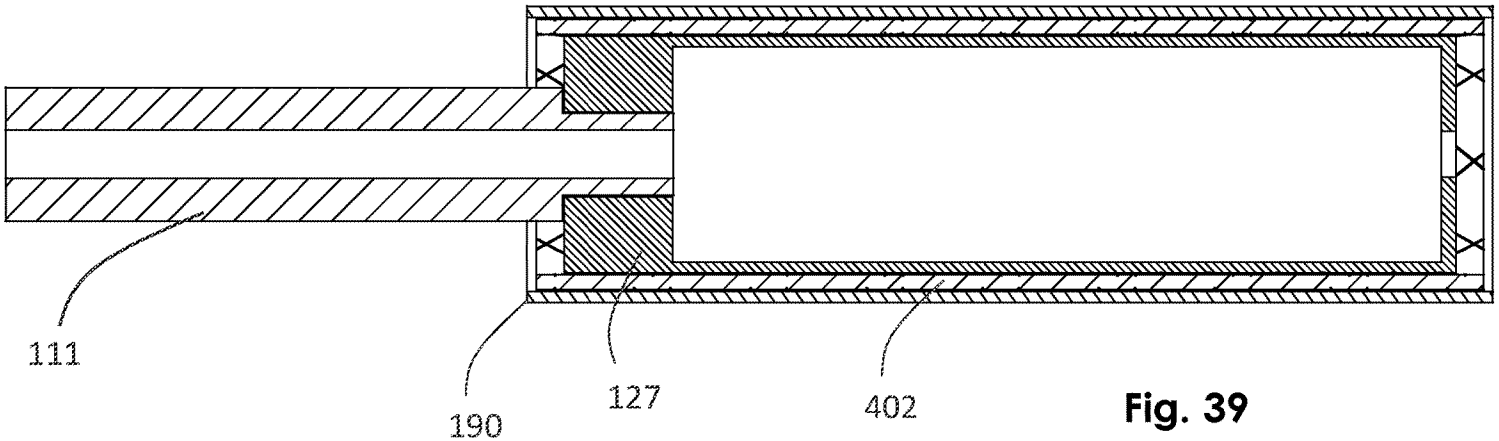
FIG. 39 is a sectional view of the embodiment depicted in FIG. 38.

Referring now to FIGS. 38-39, an embodiment of the present invention includes outer housing 190 secured to suppressor 127 through an interference fit (also known as a press fit or friction fit). The interference fit is achieved based on the size of the outer diameter of suppressor 127, thickness of internal sleeve 402, and the inner diameter of housing 190. More specifically, the inner radius of housing 190 is equal to or less than the combination of (1) the outer radius of suppressor 127 and (2) the thickness of insulating sleeve 402.

In some embodiments, the internal diameter of housing 190 is between 1 and 2 inches. In some embodiments, the internal diameter of housing 190 is between 1.25 and 1.75 inches. In some embodiments, the internal diameter of housing 190 is between 0.0625 and 0.25 inches less than the combination of the outer diameter of suppressor 127 and twice the thickness of insulating sleeve 402.

Figure 40:
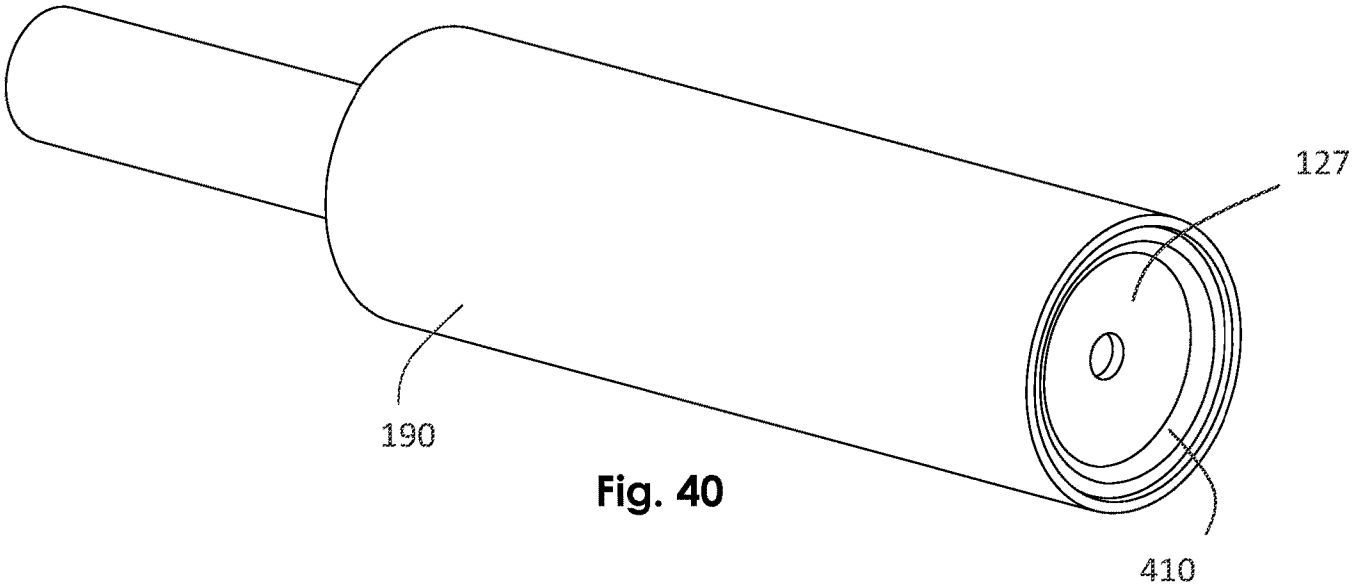
FIG. 40 is a perspective view of an embodiment of present invention mounted on a firearm suppressor and a firearm barrel.
Figure 41:
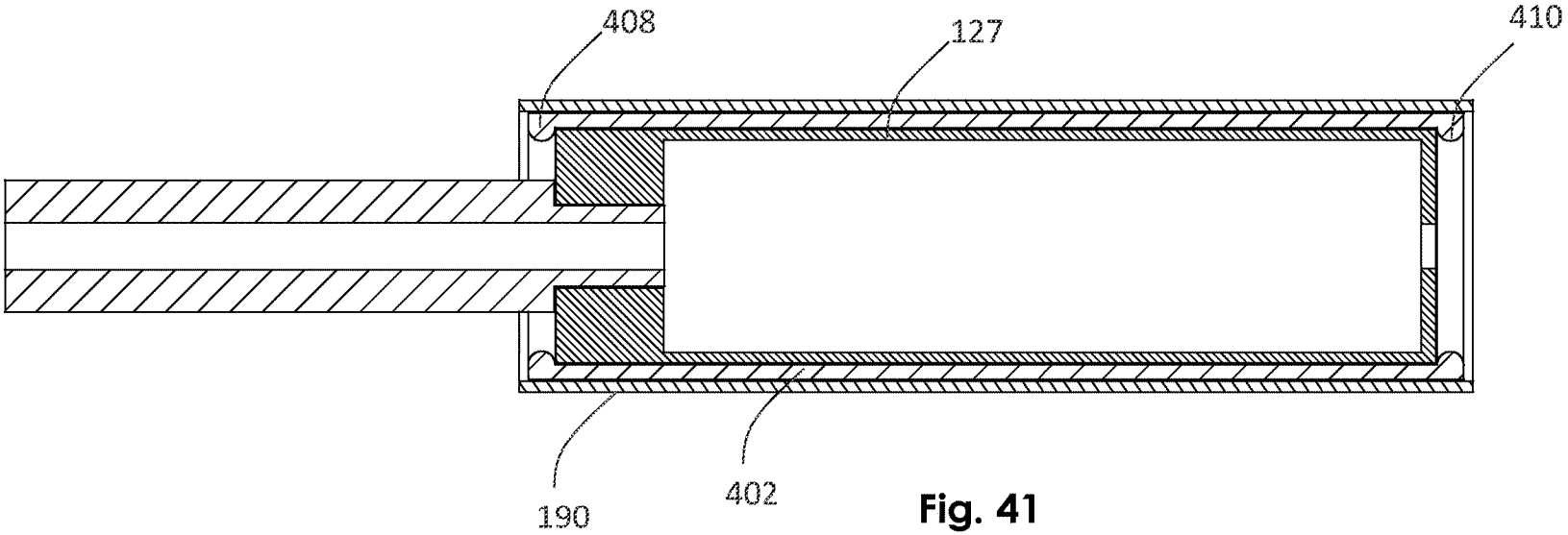
FIG. 41 is a sectional view of the embodiment depicted in FIG. 40.

As shown in FIGS. 40-41, some embodiment of insulating sleeve 402 are comprised of a compressible material. Thus, the inner radius of housing 190 is equal to or less than the combination of (1) the outer radius of suppressor 127 and (2) the thickness of insulating sleeve 402 when insulating sleeve 402 is in an uncompressed form. In some embodiments, the internal diameter of housing 190 is between 0.0625 and 0.25 inches less than the combination of the outer diameter of suppressor 127 and twice the uncompressed thickness of insulating sleeve 402. As a result, housing 190 will compress insulating sleeve 402 when ensleeving insulating sleeve 402 and suppressor 127.

As best depicted in FIG. 41, sleeve 402 may be longer than suppressor 127 resulting in uncompressed sections 408, 410 create a natural bulge proximally and distally beyond the proximal and distal ends of suppressor 127. These bulges act as longitudinal stops to prevent relative movement of housing 190 and sleeve 402 in relation to suppressor 127.

Figure 42:
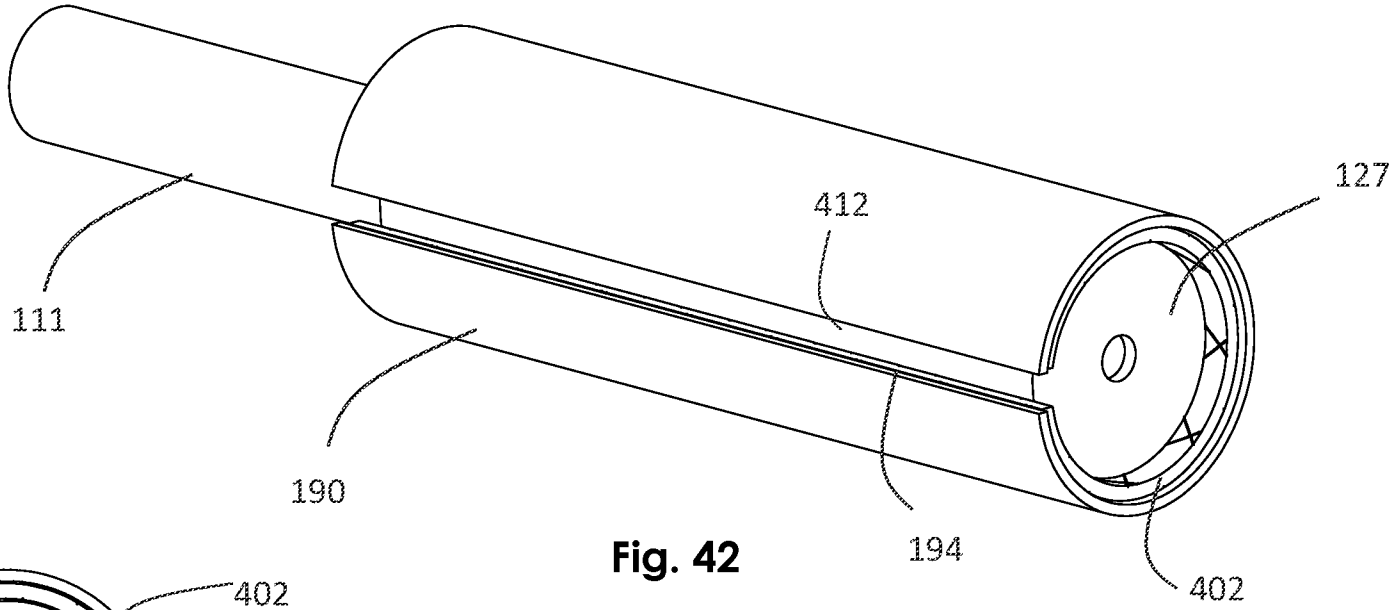
FIG. 42 is a perspective view of an embodiment of present invention mounted on a firearm suppressor and a firearm barrel.
Figure 43:
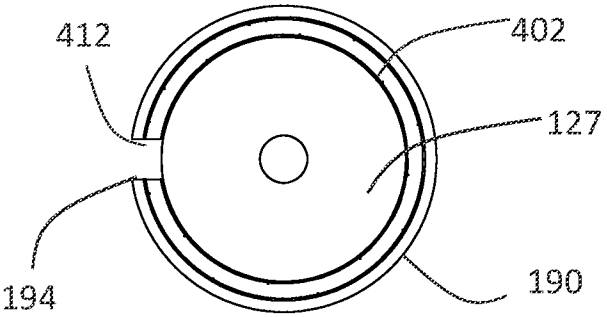
FIG. 43 is an elevation view of the proximal end of the embodiment depicted in FIG. 42.

As depicted in FIGS. 42-43, some embodiments of housing 190 includes a longitudinally extending slot 194. In some embodiments, slot 194 extends the full length of housing 190 thereby allowing housing 190 to flex open to a have a larger internal diameter. Thus, housing 190 has a diameter of repose when housing 190 is free of external forces and a variable internal diameter when subject to external forces. The diameter of repose is less than or equal to the combination of (1) the outer diameter of suppressor 127 and (2) twice the uncompressed thickness of insulating sleeve 402. When housing 190 ensleeves sleeve 402 and suppressor 127, it is flexed radially to have a greater diameter than diameter of repose and applies a clamping force around sleeve 402 and suppressor 127.

Slot 194 has a width (expanse in a circumferential direction) that is less than half of the circumference of housing 190 if no slot was present. As such, housing 190 will circumferentially wrap around suppressor 127 to apply a clamping force and remain attached to suppressor 127. Some embodiments may also include a clamping mechanism, such as a cam member, circular clamp, etc., to further aid in clamping housing 190 to around suppressor 127.

In some embodiments, the internal diameter of repose of housing 190 is between 1 and 2 inches. In some embodiments, the internal diameter of repose of housing 190 is between 1.25 and 1.75 inches. In some embodiments, the internal diameter of repose of housing 190 is between 0.0625 and 0.25 inches less than the combination of the outer diameter of suppressor 127 and twice the uncompressed thickness of insulating sleeve 402.

In some embodiments, sleeve 402 is sized to fully ensleeve suppressor 190. However, as depicted in FIGS. 42-43, an embodiment of sleeve 402 is sized to create longitudinal slot 412 which can be generally aligned with longitudinal slot 194 in housing 190. These slots help to transfer heat from suppressor 127 to the ambient air.

For similar reasons, an embodiment of sleeve 402 may be comprised of a plurality of discreet strips. As a result, heat from suppressor 127 can more freely transfer to the ambient air.

Figure 45:
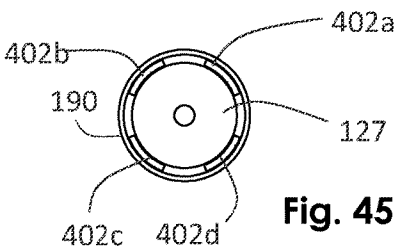
FIG. 45 is an elevation view of the proximal end of the embodiment depicted in FIG. 44.
Figure 44:
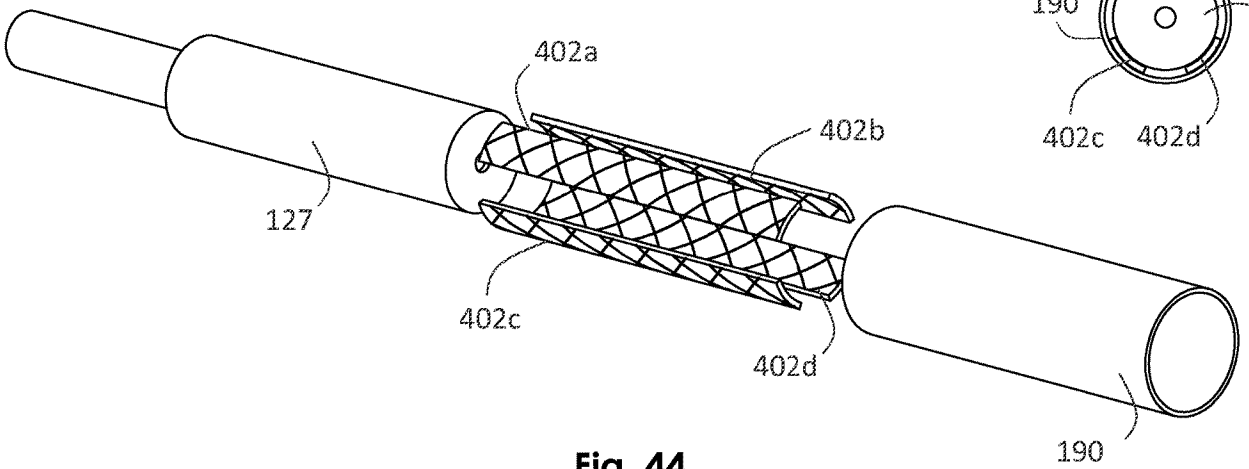
FIG. 44 is an exploded perspective view of an embodiment of the present invention.

As shown in FIGS. 44-45, an embodiment of sleeve 402 may be comprised of four discreet strips 402*a*-402*d*. However, sleeve 402 may be comprised of two or more discreet strips arranged about the circumference of suppressor 127 to prevent housing 190 from contact suppressor 127. In some embodiments, the strips are equidistantly arranged about the circumference of suppressor 127 to ensure that heat is evenly transferred from suppressor 127 to the ambient air.

Furthermore, the discreet longitudinally extending strips may have any longitudinal length extending generally in a longitudinal direction (a direction parallel to the central longitudinal axis of the suppressor). However, some embodiments of the discreet longitudinal strips have a length of at least half of the length of suppressor 127. The strips may be positioned at different locations along suppressor 127/housing 190 or may be positioned at generally the same longitudinal location with respect to suppressor 127/housing 190.

Figure 46:
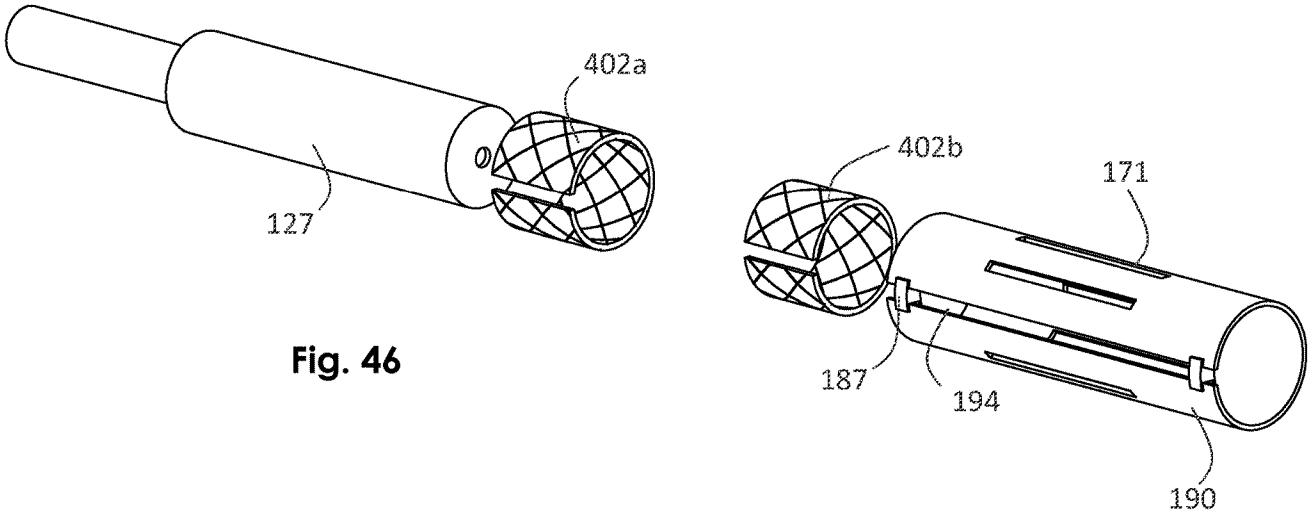
FIG. 46 is an exploded perspective view of an embodiment of the present invention.

While FIGS. 44-45 depict sleeve strips 402*a*-402*d* extending in a generally longitudinal direction, sleeve strips 402*a*, 402*b* may be oriented to circumscribe the outer diameter of suppressor 127 as shown in FIG. 46. Moreover, circumscribing sleeve strips may extend the full circumference of suppressor 127 or only a partial circumference of suppressor 127 so long as the circumscribing sleeve strips prevent housing 190 from contacting suppressor 127.

While FIG. 46 depicts two circumscribing sleeve strips 402*a*, 402*b*, some embodiments may have more than two. Moreover, the circumscribing sleeve strips may be in opposite halves of the length of suppressor 127 or may be sufficiently spaced to ensure that housing 190 does not come into direct contact with suppressor 127. Furthermore, the discreet strips may extend generally any distance in a longitudinal direction (a direction parallel to the central longitudinal axis of the suppressor), so long as the strips prevent direct contact between suppressor 127 and housing 190.

Like other embodiments of sleeve 402, the discreet strips (regardless of whether they extend longitudinally or circumferentially) may be attachable or integrated with housing 190 or the discreet strips may be sandwiched between housing 190 and suppressor 127.

Figure 47:
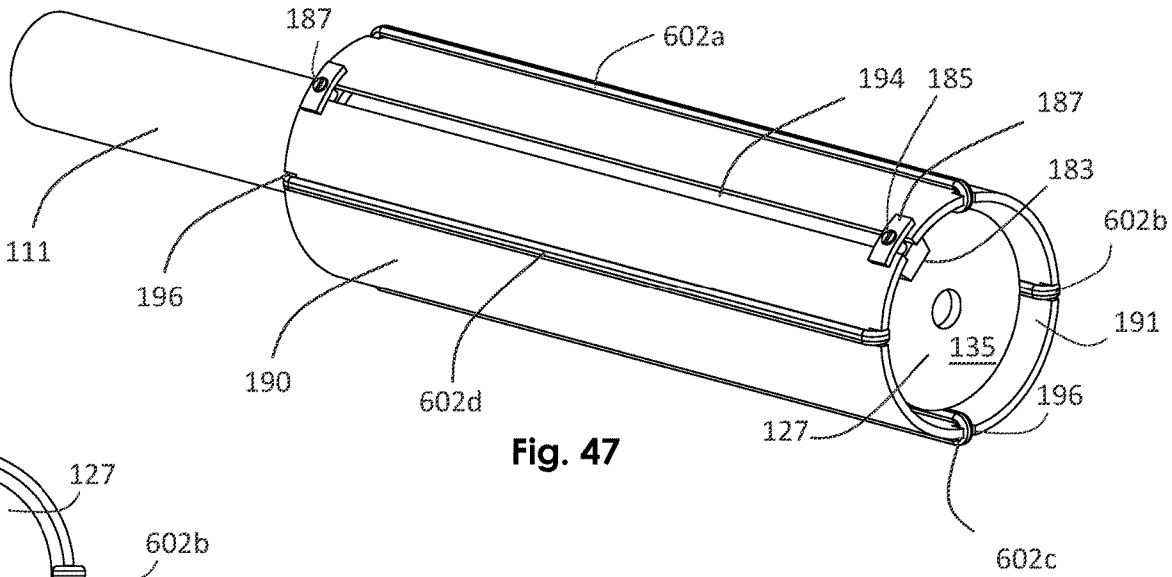
FIG. 47 is a perspective view of an embodiment of present invention mounted on a firearm suppressor and a firearm barrel.
Figure 48:
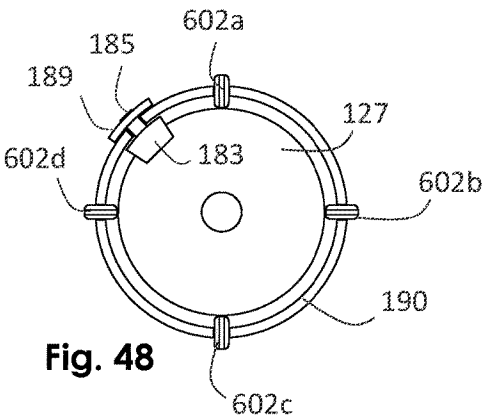
FIG. 48 is an elevation view of the proximal end of the embodiment depicted in FIG. 47.
Figure 49:
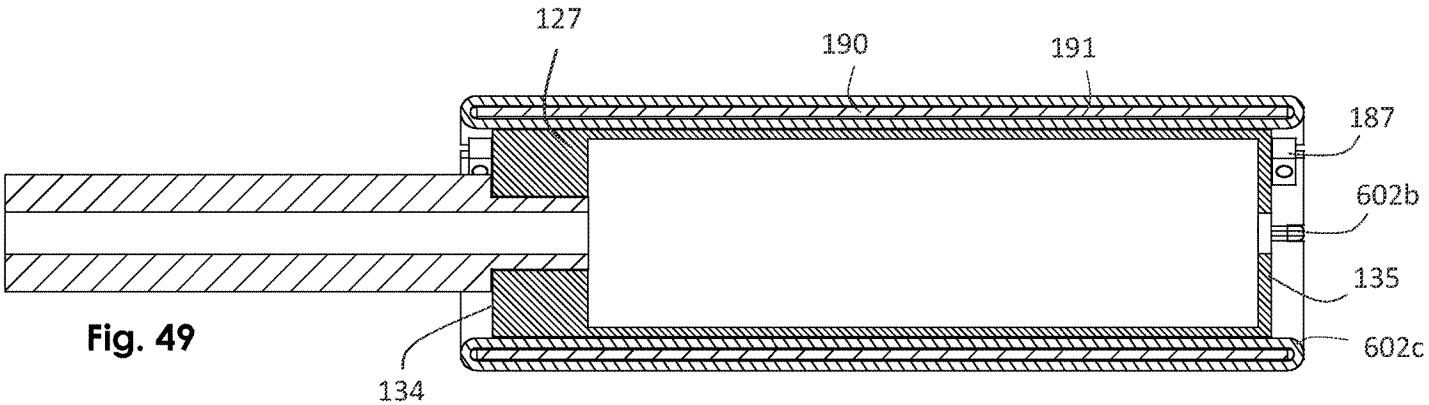
FIG. 49 is a sectional view of the embodiment depicted in FIG. 47.

As exemplified in FIGS. 47-49, insulating sleeve 402 may be in the form of insulating rope 600. Insulating rope 600 is preferably comprised of an insulating textile material to prevent marking and marring of outer surface 129 of suppressor 127 when press fitting housing 190 onto suppressor 127. However, insulating rope 600 may be comprised of any insulating material, such as those described in relation to the insulating sleeve, any other polymers, fibers, textiles, rubber, mesh textiles, and other reflective/insulating materials that will not mark or mar the outer surface 129 of suppressor 127 when housing 190 is press fit onto suppressor 127.

Moreover, some embodiments of insulating rope 600 are comprised of a compressible material. Again, like other embodiments of sleeve 402, insulating rope 600 may be attachable or integrated with housing 190 or may be sandwiched between housing 190 and suppressor 127.

As shown in FIGS. 47-49, the insulating sleeve may be comprised of a plurality of discreet rope members 600*a*-600*d*. The exemplary embodiment depicted includes four discreet rope members, but some embodiments include two or more discreet rope members. Moreover, the rope members are preferably equidistantly spaced about the circumference of housing 190. However, the rope members may be adequately spaced to ensure that housing 190 does not come into direct contact with suppressor 127.

The embodiment depicted in FIGS. 47-49 includes rope members 602*a*-602*d* each extending generally the length of housing 190 and wrapping securely around the lateral wall of which housing 190 is comprised. As depicted, rope members 602*a*-602*d* each pass through notches 196 formed in the proximal and distal ends of housing 190. Notches 196 help keep rope members 602*a*-602*d* secured at a desired location.

In some embodiments, insulating sleeve 402 is comprised of a single rope member that weaves multiple times around the lateral wall of which housing 190 is comprised. In some embodiments, insulating sleeve 402 is comprised of a single rope member that winds multiple times around the inner circumference of housing 190. In some embodiments, insulating sleeve 402 is comprised of discreet rope members that each wind one or more times around the inner circumference of housing 190. Alternatively, insulating sleeve 402 may be a single rope member or multiple discreet rope members that wind around the outer circumference of suppressor 127.

Figure 50:
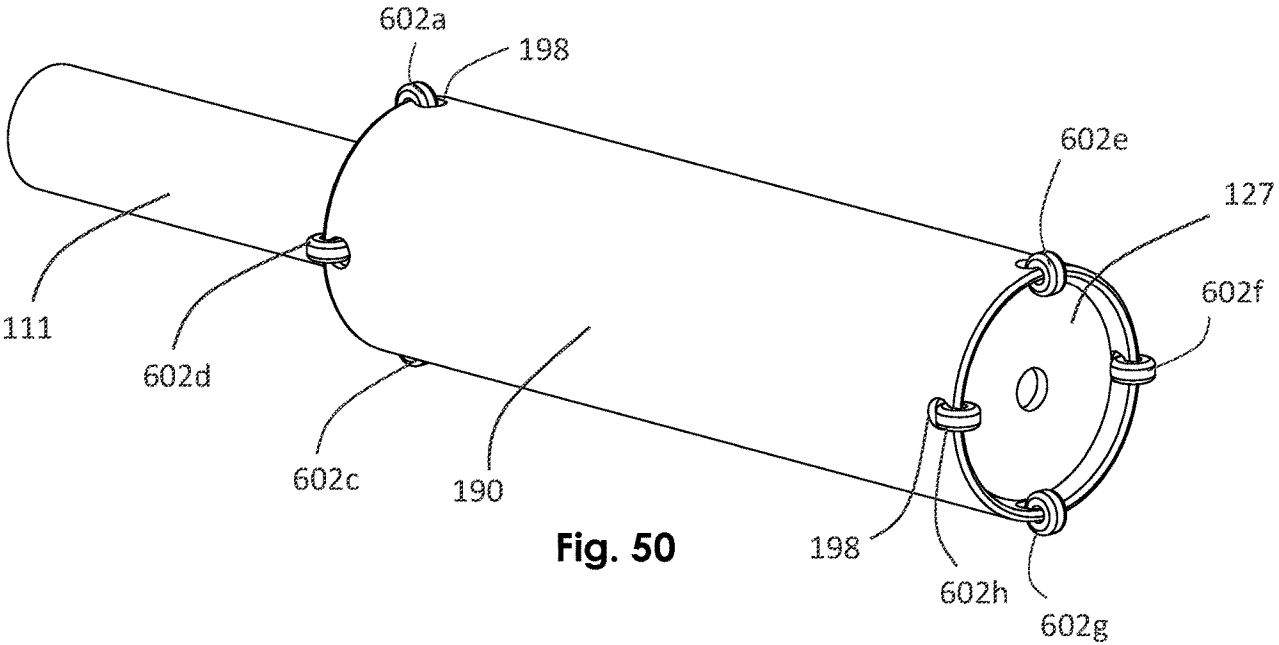
FIG. 50 is a perspective view of an embodiment of present invention mounted on a firearm suppressor and a firearm barrel.
Figure 51:
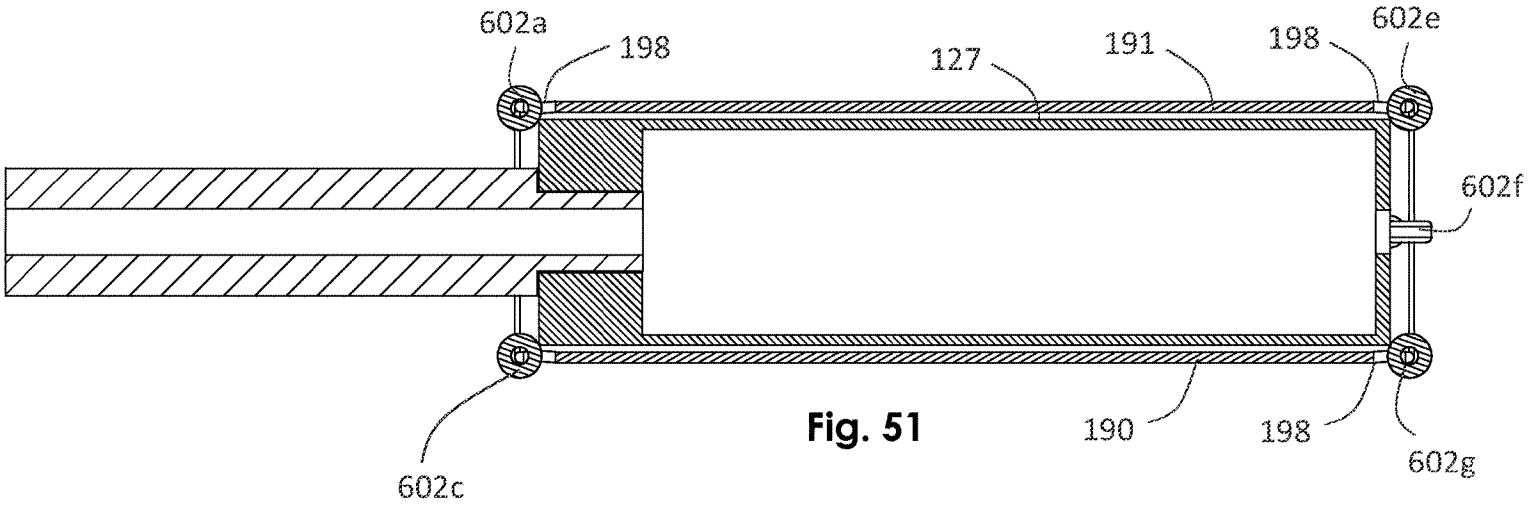
FIG. 51 is a sectional view of the embodiment depicted in FIG. 50.

As depicted in FIGS. 50-51, the insulating sleeve may be comprised of a plurality of discreet rope members 602*a*-602*h* (600*b* is not visible due to angle of views) located near the proximal and distal ends of housing 190. Housing 190 includes openings 198 disposed through the lateral wall allowing sections of rope members 602*a*-602*h* to pass through housing 190. Openings 198 are disposed at a location in which the opening are laterally adjacent to suppressor 127. As such, at least a portion of each discreet rope member 602*a*-602*h* will reside between suppressor 127 and housing 190.

Some embodiments may include openings 198 as shown in FIGS. 50-51 with the rope members 602*a*-602*d* from FIGS. 47-49 extending between the proximal and distal openings. Moreover, a single rope member may extend through the various openings 198 in a crisscross-like pattern.

Figure 52:
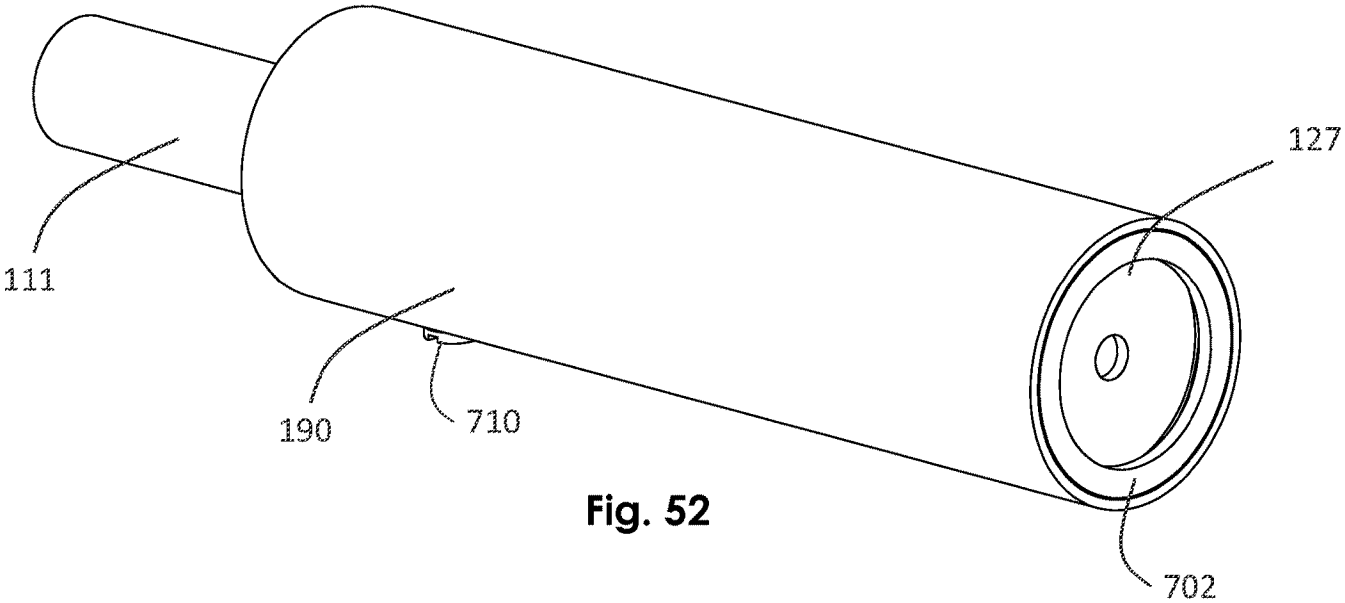
FIG. 52 is a perspective view of an embodiment of present invention mounted on a firearm suppressor and a firearm barrel.
Figure 53:
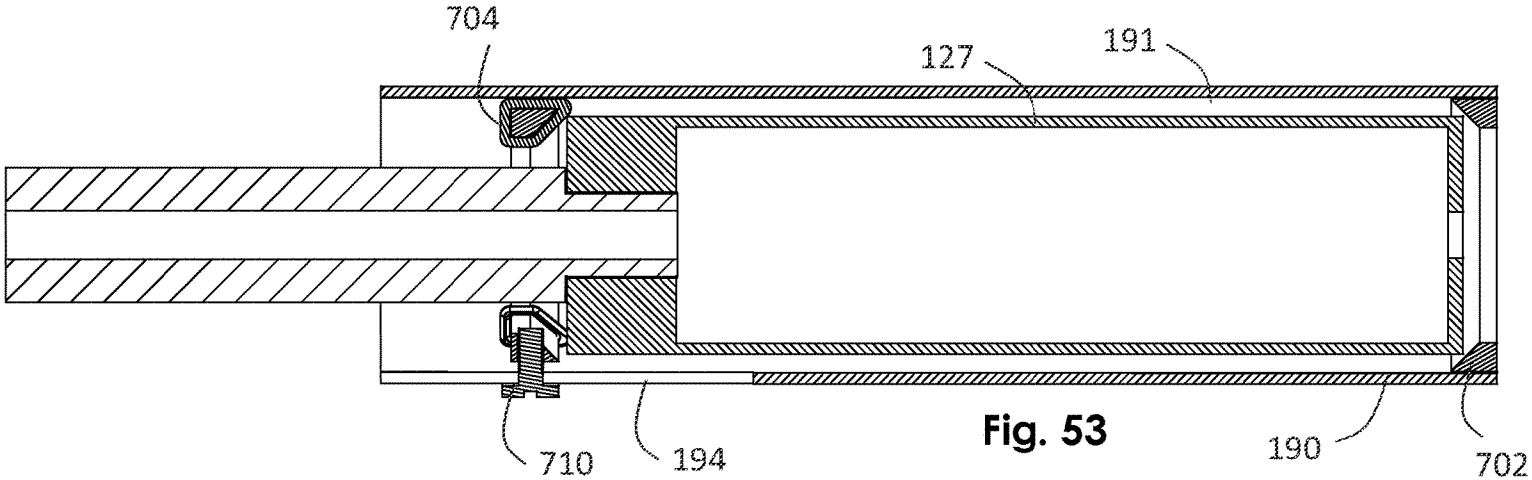
FIG. 53 is a sectional view of the embodiment depicted in FIG. 52.

Referring now to FIGS. 52-53, an embodiment of the insulating sleeve is comprised of distal annular sleeve 702 and proximal annular sleeve 704. Each annular sleeve may be attachable or integrated with housing 190. Each stop may be comprised of pressed fabric, mold injected resin, rope, alloy wrapped with rope or fabric, or any other materials identified in alternative embodiments disclosed herein. Each annular sleeve may include additional insulating material or rope located on the tapered contacting surface of the sleeve.

As shown, each annular sleeve includes a tapered contacting surface 706, 708 which keeps suppressor 127 from contacting housing 190. Alternative embodiments may include stepped annular sleeves with spacers between housing 190 and suppressor 127.

The depicted embodiment includes fastener 710, which threadedly engages proximal sleeve 704. Fastener 710 can translate through slot 194 located in at least a section of housing 190 to allow fastener 710 and proximal sleeve 704 to translate along the length of housing 190 and thereby accommodate suppressors of various sizes.

Some embodiments of housing 190 include one or more stops 187. Stops 187 are configured to translate along slot 194 (or another slot in housing 190) to prevent housing 190 from moving relative to suppressor 127 when stops 187 are secured in adjacent location to proximal and distal faces 134, 135 of suppressor 127. Stops 187 extend inwardly from housing 190 a distance that is greater than the difference between the radius of housing 190 and suppressor 127 to ensure that stops 187 contact suppressor 127.

The depicted stop 187 is in the form of securing plate 189 secured to extending body 183 via a fastener 185. Fastener 185 threadedly engages extending body 183 to clamp housing 190 between securing plate 189 and extending body 183. However, alternative stops may be used to prevent relative axial movement of housing 190 and suppressor 127. For example, in some embodiments, stop 187 is in the form of an insulating rope member that spans across at least a portion of the open proximal and/or distal end of housing 190 so as to prevent longitudinal movement of suppressor 127 relative to housing 190 once stop 187 is in place.

Figure 54:
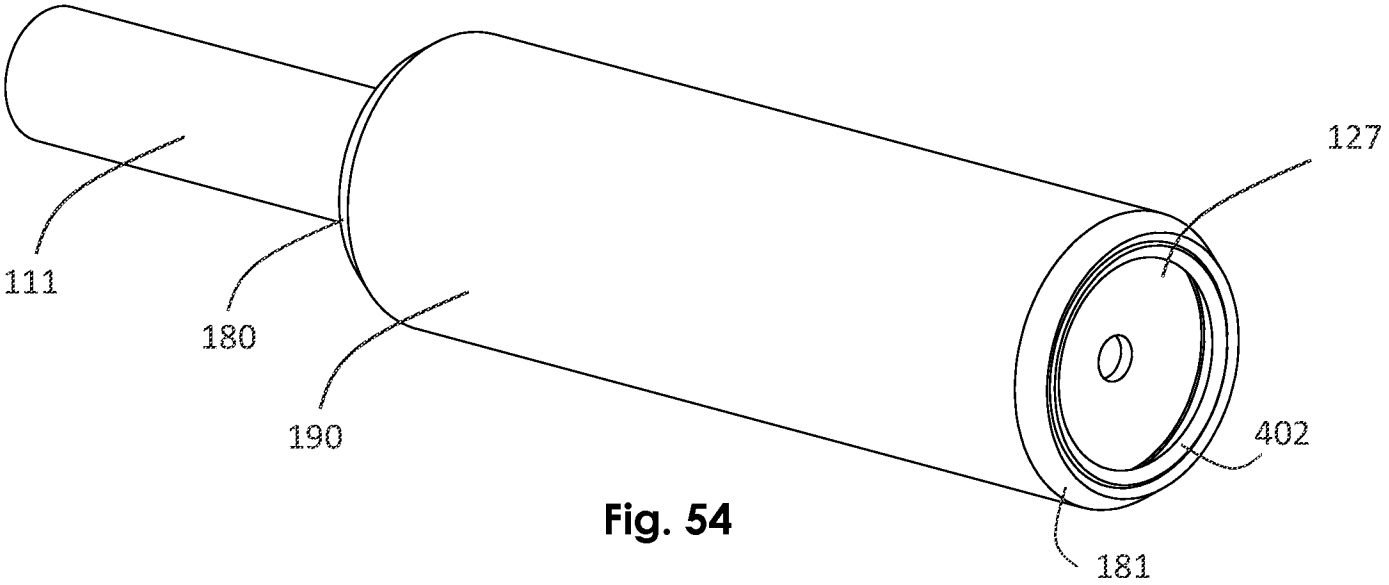
FIG. 54 is a perspective view of an embodiment of present invention mounted on a firearm suppressor and a firearm barrel.
Figure 55:
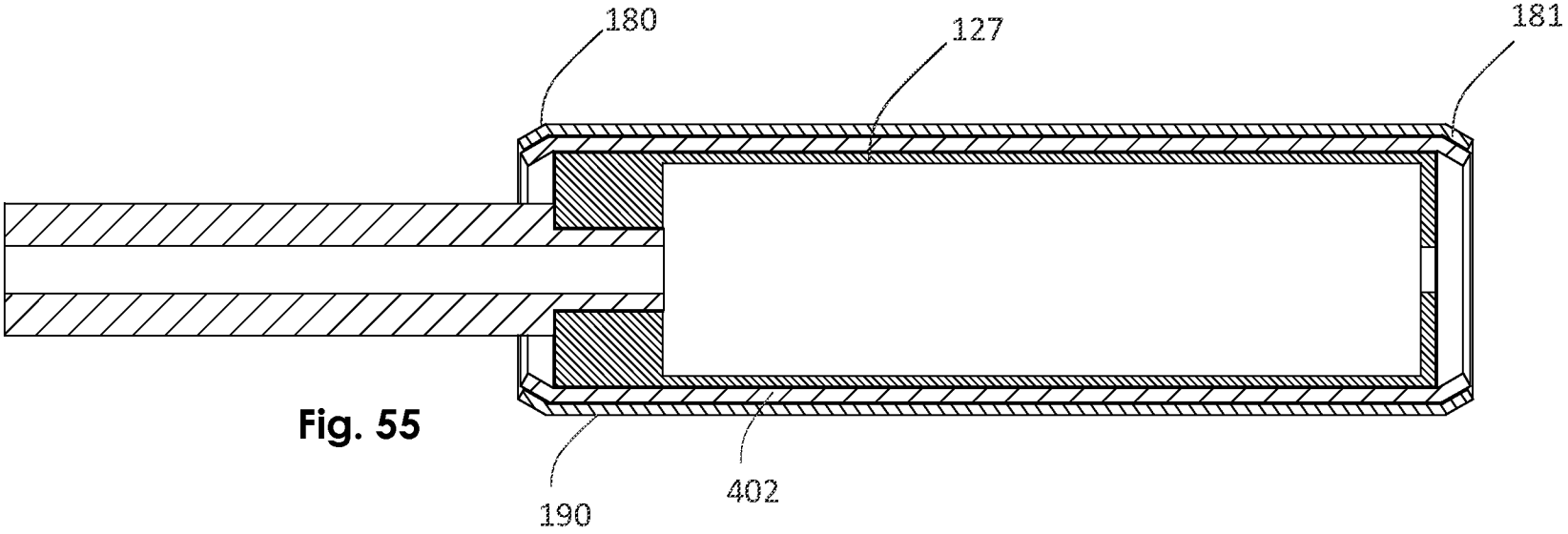
FIG. 55 is a sectional view of the embodiment depicted in FIG. 54.

Referring now to FIGS. 54-55, some embodiments of housing 190 include first tapered section 180 and/or second tapered section 181. The tapered sections are preferably located at the proximal and distal ends of housing 190 to help retain housing 190 in a location relative to suppressor 127. Insulating sleeve 402 may likewise have first and second tapered sections or the sections are simply forced into an inwardly taper on account of the tapered sections of housing 190.

In some embodiments, housing 190 include first tapered section 180 tapering outwardly rather than inwardly as shown in FIGS. 54-55. The outward taper helps to prevent the insulating sleeve from bunching when press fitting housing 190 onto suppressor 127.

Housing 190 may also include one or more venting slots 171 to transfer heat. Housing 190 may also include any textures, patterns, vents, in outer shield to dissipate heat as described in various embodiments.

Some embodiments of housing 190 may include inwardly extending flanges or channels carved into the internal surface of housing 190. These flanges or channels help to secure insulating sleeve 402, in any of its various forms, at a desired location relative to housing 190.

The insulation sleeves, outer housing, and other components may be comprised of alloys, polymers, ceramics, glass fibers, textiles, rubber, mesh textiles, reflective materials, or other insulating materials. Moreover, the various components could be porous and/or have internally facing reflective surfaces (e.g. alloys can be polished to reflect heat or a reflective surface can be applied to the inner surfaces) to aid in preventing the transfer of heat to the outer housing. Outer housing 190, however, is preferably comprised of a rigid or semi-rigid material rather than a soft, flexible fabric.

In an embodiment, outer housing 190 may have an open bottom half or have one or more openings facing downwards to allow heat to escape out of the bottom of the housing.

In an embodiment, the outer shield and the one or more insulating sleeves have a length equal to at least 50% the length of the suppressor. In an embodiment, the outer shield and the one or more insulating sleeves have a length greater than or equal to the length of the suppressor.

Glossary of Claim Terms

Compression Surface: is a surface adapted to exert a force against a second surface, such that the second surface translates as a result of the contact with the compression surface.

Exterior Environment: is the space surrounding a structure, through which audible and visual effects can be detected.

Firearm Barrel: is a discharging tube of a firearm, including any extension or aftermarket addition.

Firearm Suppressor: is a device having a plurality of baffles that attaches to a firearm and reduces the amount of detectable noise, light, and heat generated by firing the firearm.

Fluidic Channel: is channel adapted to allow the flow of fluids between two chambers.

Levered Attachment Arm: is a structure that is adapted to radially translate with respect to a firearm suppressor. The levered attachment arm is actuated by another structure, such as the compression surface.

Residual Effect: is an audible or visual effect of a firearm discharge that may be noticeable after being reduced by a firearm suppressor.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A method of reducing the possibility of burning oneself on a firearm suppressor using a suppressor shield, the method comprising:

receiving a firearm and the firearm suppressor, wherein the firearm suppressor is attached to or attachable to a barrel of the firearm and the firearm suppressor includes a nonperforated outer lateral surface adapted to contain gasses generated from discharging the firearm;

securing a housing of the suppressor shield at least partially around the firearm suppressor via an interference fit, wherein the housing includes:

a bore extending in a longitudinal direction, the bore establishing a rigid lateral wall and an interior receiving space for receiving at least a portion of the firearm suppressor;

an outer surface;

an internal surface establishing the boundaries of the bore;

a proximal aperture having a diameter greater than a diameter of the firearm suppressor, thereby allowing the firearm suppressor to be received within the bore;

a distal projectile aperture;

an insulating sleeve secured or attachable to the housing with at least a portion of the insulating sleeve residing between the internal surface of the housing and the outer lateral surface of the firearm suppressor when the housing is attached to the firearm suppressor;

whereby the insulating sleeve prevents the internal surface of the housing from directly contacting the outer lateral surface of the firearm suppressor when the housing is attached to the firearm suppressor;

a longitudinal slot extending a length of the housing, such that a diameter of the internal surface of the housing can change from an unflexed diameter to a larger diameter when the housing is subjected to a force;

an unflexed radius of the internal surface of the housing having a value less than the sum of (1) an outer radius of the firearm suppressor and (2) a thickness of the insulating sleeve;

whereby at least some residual effects from discharging the firearm are dispersed throughout the suppressor shield.

2. The method of claim 1, wherein the rigid lateral wall of the housing is more rigid than the insulating sleeve.

3. The method of claim 1, wherein the insulating sleeve is comprised of a plurality of longitudinally extending strips of insulating material.

4. The method of claim 1, wherein the insulating sleeve is comprised of a plurality of strips of insulating material extending around a circumference of the internal surface of the housing.

5. The method of claim 1, wherein the insulating sleeve is comprised of a plurality of discrete insulating ropes.

6. The method of claim 5, wherein the housing includes a plurality of notches or openings passing through the lateral wall of the housing and one or more of the plurality of discrete insulating ropes passes through each of the plurality of notches or openings.

7. The method of claim 1, wherein the insulating sleeve is comprised of a compressible textile to aid in creating the interference fit.

8. The method of claim 1, wherein the housing includes one or more stops, wherein each of the one or more stops:

is configured to translate within the longitudinal slot and be secured to the housing at a particular location along the longitudinal slot; and extends a distance inwardly towards a longitudinal axis of the firearm suppressor, wherein the distance is greater than a radial distance between the internal surface of the housing and the outer lateral surface of the firearm suppressor when the housing encloses the firearm suppressor.

9. The method of claim 1, wherein the housing includes a plurality of vents laterally disposed through the lateral wall of the housing.

10. The method of claim 1, wherein the housing includes a plurality of recessed features disposed in the outer surface.

11. A suppressor shield for protecting oneself from a hot firearm suppressor, the suppressor shield comprising:

a housing configured to at least partially enclose the firearm suppressor via an interference fit, wherein the housing includes:

a bore extending in a longitudinal direction, the bore establishing a rigid lateral wall and an interior receiving space for receiving at least a portion of the firearm suppressor;

an outer surface;

an internal surface establishing the boundaries of the bore;

a proximal aperture having a diameter greater than a diameter of the firearm suppressor, thereby allowing the firearm suppressor to be received within the bore;

a distal projectile aperture;

a longitudinal slot extending a length of the housing, such that a diameter of the internal surface of the housing can change from an unflexed diameter to a larger diameter when the housing is subjected to a force;

an insulating sleeve configured to reside between the internal surface of the housing and an outer lateral surface of the firearm suppressor when the housing is attached to the firearm suppressor;

the internal surface of the housing having a radius that is less than the sum of (1) an outer radius of the firearm suppressor and (2) a non-compressed thickness of the insulating sleeve;

whereby the insulating sleeve prevents the internal surface of the housing from directly contacting the outer lateral surface of the firearm suppressor when the housing encloses at least a portion of the firearm suppressor to reduce the transfer of heat from the firearm suppressor to the housing.

12. The suppressor shield of claim 11, further comprising:

the rigid lateral wall of the housing is comprised of a more rigid material than the insulating sleeve.

13. The suppressor shield of claim 11, wherein the insulating sleeve is comprised of a plurality of strips of insulating material.

14. The suppressor shield of claim 11, wherein the insulating sleeve is comprised of a plurality of insulating ropes.

15. The method of claim 14, wherein the housing includes a plurality of notches or openings passing through the lateral wall of the housing and one or more of the plurality of insulating ropes passes through each of the plurality of notches or openings.

16. The suppressor shield of claim 11, wherein the insulating sleeve is comprised of a compressible textile to aid in creating the interference fit.

17. The suppressor shield of claim 11, wherein the housing includes one or more stops, wherein each of the one or more stops:

is configured to translate within the longitudinal slot and be secured to the housing at a particular location along the longitudinal slot; and extends a distance inwardly towards a longitudinal axis of the firearm suppressor, wherein the distance is greater than a radial distance between the internal surface of the housing and the outer lateral surface of the firearm suppressor when the housing encloses the firearm suppressor.

18. The suppressor shield of claim 11, wherein the housing includes a plurality of vents laterally disposed through the lateral wall of the housing.

19. The suppressor shield of claim 11, wherein the housing includes a plurality of recessed features disposed in the outer surface.

20. A suppressor shield for protecting oneself from a hot firearm suppressor, the suppressor shield comprising:

a housing configured to at least partially enclose the firearm suppressor via an interference fit, wherein the housing includes:

a bore extending in a longitudinal direction, the bore establishing a rigid lateral wall and an interior receiving space for receiving at least a portion of the firearm suppressor;

an outer surface;

an internal surface establishing the boundaries of the bore;

a proximal aperture having a diameter greater than a diameter of the firearm suppressor, thereby allowing the firearm suppressor to be received within the bore;

a distal projectile aperture;

an insulating sleeve configured to reside between the internal surface of the housing and an outer lateral surface of the firearm suppressor when the housing is attached to the firearm suppressor, whereby the insulating sleeve prevents the internal surface of the housing from directly contacting the outer lateral surface of the firearm suppressor when the housing is attached to the firearm suppressor to reduce the transfer of heat from the firearm suppressor to the housing;

the insulating sleeve comprised of a compressible material, such that the insulating sleeve has a compressed thickness and a non-compressed thickness; and the internal surface of the housing having a radius that is less than the sum of (1) an outer radius of the firearm suppressor and (2) the non-compressed thickness of the insulating sleeve.

* * * * *